US010730590B2

(12) United States Patent
Healy

(10) Patent No.: US 10,730,590 B2
(45) Date of Patent: Aug. 4, 2020

(54) SYSTEM AND METHOD FOR RETRIEVING A VESSEL FROM WATER

(71) Applicant: THRUST MARITIME HOLDINGS PTY LTD, Melbourne, Victoria (AU)

(72) Inventor: Benjamin Thomas Healy, Melbourne (AU)

(73) Assignee: THRUST MARITIME HOLDINGS PTY LTD, Melbourne (AU)

( * ) Notice: Subject to any disclaimer, the term of this patent is extended or adjusted under 35 U.S.C. 154(b) by 31 days.

(21) Appl. No.: 15/739,653

(22) PCT Filed: Jun. 17, 2016

(86) PCT No.: PCT/AU2016/000207
§ 371 (c)(1),
(2) Date: May 14, 2018

(87) PCT Pub. No.: WO2016/205856
PCT Pub. Date: Dec. 29, 2016

(65) Prior Publication Data

US 2018/0265172 A1 Sep. 20, 2018

(30) Foreign Application Priority Data

Jun. 24, 2015 (AU) ..... 2015902439

(51) Int. Cl.
*B66C 13/02* (2006.01)
*B66C 23/52* (2006.01)
(Continued)

(52) U.S. Cl.
CPC ..... *B63B 23/52* (2013.01); *B63B 23/06* (2013.01); *B63B 23/48* (2013.01); *B66C 1/36* (2013.01);
(Continued)

(58) Field of Classification Search
CPC ..... B63B 23/52; B63B 23/06; B63B 23/48; B63B 23/60; B63B 23/02; B63B 23/40;
(Continued)

(56) References Cited

U.S. PATENT DOCUMENTS 3,967,735 A 7/1976 Payne

FOREIGN PATENT DOCUMENTS

AU 2012100144 A4 3/2012
CA 2725954 A1 * 6/2011 ..... B63B 23/58
(Continued)

*Primary Examiner* — Anthony D Wiest
(74) *Attorney, Agent, or Firm* — Insigne LLP

(57) ABSTRACT

There is disclosed a retrieval system for retrieving a vessel from water to a deck of a recovery vessel, comprising: a lifting device mounted on the deck of the recovery vessel, the device comprising a substantially vertically extending structure and a lifting hook mounted to said substantially vertically extending structure so as to be raised and lowered therefrom by way of a first winch; a connection lead having a free end configured to detachably connect to a connection link of the vessel to be retrieved from the water an opposing end of the connection lead being located on the recovery vessel; a capture member mounted with respect to the lifting hook to capture the connection link of the vessel when the free end of the connection lead is raised towards the lifting hook; and a control member mounted with respect to the lifting hook of the lifting device and configured to receive at least a portion of the connection lead so as to direct the connection link to the capture member to be captured thereby as the free end of the connection lead is raised towards the lifting hook; wherein upon capture of the connection link by the capture member the winch is operated to facilitate lifting of the vessel from the water to the deck of the recovery vessel.

11 Claims, 41 Drawing Sheets

(51) Int. Cl.

| | |
|---|---|
| ***B66C 1/36*** | (2006.01) |
| ***B63B 23/48*** | (2006.01) |
| ***B63B 23/52*** | (2006.01) |
| ***B66D 1/52*** | (2006.01) |
| ***B63B 23/06*** | (2006.01) |
| ***B66C 13/40*** | (2006.01) |

(52) U.S. Cl.
CPC ..... *B66C 13/02* (2013.01); *B66C 13/40* (2013.01); *B66C 23/52* (2013.01); *B66D 1/525* (2013.01)

(58) Field of Classification Search
CPC B63B 27/36; B66C 13/40; B66C 1/36; B66C 23/52; B66C 13/02; B66C 1/34; B66D 1/525; B63C 7/00
USPC ..... 114/365, 366, 368, 377, 378, 379
See application file for complete search history.

(56) References Cited

FOREIGN PATENT DOCUMENTS

| | | | |
|---|---|---|---|
| GB | 191316245 | A | 7/1914 |
| GB | 504908 | A | 5/1939 |
| JP | H10279289 | A | 10/1998 |
| JP | 2003040578 | A | 2/2003 |
| WO | 2014150950 | A2 | 9/2014 |

* cited by examiner

SYSTEM AND METHOD FOR RETRIEVING A VESSEL FROM WATER

RELATED APPLICATIONS

The present application claims priority from earlier filed Australian Provisional Patent Application No. 2015902439, filed 24 Jun. 2015, the entire contents of which are incorporated herein by reference.

FIELD OF INVENTION

The present invention relates generally to a system and method for retrieving a vessel from water, and in particular, to a system and method for retrieving a hyperbaric lifeboat or capsule from the sea, especially in rough or difficult conditions.

BACKGROUND OF THE INVENTION

In order to avoid loss of life at sea, the International Maritime Organisation (IMO) has placed significant attention towards the requirement for all ships at sea to carry lifesaving equipment and to maintain such equipment in an order suitable for use in the event of an incident that requires personnel to abandon the ship.

For many passenger ships, there is a requirement to carry lifeboats which can be used to carry passengers and crew which can be deployed from the ship in an emergency to evacuate the passengers and crew from immediate danger. The lifeboat may take a variety of forms and may be self-propelled and have provisions contained therein which provide a degree of control to the passengers of the lifeboat and the ability to survive until they are rescued by a rescue craft or the like.

In the Marine Oil and Gas industry, there is a requirement to employ highly skilled diving contractors to spend large periods of time underwater at significant depths to perform a variety of tasks, such as the maintenance and repair of subsea infrastructure. Due to the extreme depths at which the divers are required to operate and the duration at which they are required to remain underwater, the divers are maintained at a desired pressure for the duration of their time at work, this aids in avoiding health risks associated with undergoing multiple decompression processes, and the time associated therewith. Such a phenomena is known as saturation diving.

In instances where saturation diving is employed, a dive support vessel stationed at sea is equipped with a hyperbaric environment on the water surface to which the divers can retreat to rest and sleep when they are not working underwater. The hyperbaric environment generally comprises a set of linked pressure chambers made up of living chambers and transfer chambers that allow the divers to retreat to a living chamber when not working underwater, without having to undergo decompression after each dive. As it is not uncommon for the divers to work on a project for several days or weeks, the divers only require decompression to surface pressure at the end of their work, which can be done at a conservative rate to reduce the potential for decompression illness.

It will be appreciated that in such a saturation environment, any exposure of the individual to surface atmospheric pressure will quickly result in the individual becoming severely sick, with death being a real possibility. As such, in the event of a problem associated with the dive support vessel or the saturation system whilst at sea, such as a fire or the like that requires an emergency evacuation, care needs to be taken to ensure that the divers are able to be evacuated and maintained at the appropriate pressure consistent with their previous environment.

For this purpose hyperbaric lifeboats and hyperbaric rescue capsules have been developed to provide a means for divers to evacuate from the environment whilst being maintained at the desired pressure. A hyperbaric lifeboat is typically manned by a coxswain and crew who are at surface pressure and can sail the lifeboat to an appropriate decompression facility or rescue vessel. Within the lifeboat, the divers are contained within a compartment that is maintained at saturation pressure such that they are not exposed to surface pressure. Similarly, a hyperbaric rescue capsule provides one or more hyperbaric chambers for accommodating one or more divers, but the capsule is not manned by a coxswain and/or crew.

At present, hyperbaric lifeboats and rescue capsules are capable of maintaining a pressurised environment for a minimum period of 72 hours. Within this period the lifeboat or rescue capsule, is to be retrieved from the water and transported to a Hyperbaric Reception Facility to undergo a controlled decompression routine to return the divers to atmospheric pressure. Failure to retrieve the divers in this time period may result in the death of the divers.

Thus, it is important that if a hyperbaric lifeboat or rescue capsule has been deployed it is collected and returned to a hyperbaric reception facility as quickly as possible. For this purpose, many vessels are fitted with cranes to facilitate lifting of the lifeboat or capsule from the water for transportation.

One such crane or lifting system that has been proposed for this purpose is disclosed in Australian Innovation Patent No. 2012100144, the entire contents of which are incorporated herein by reference. This patent discloses an A-frame type lifting device that is fitted to the stern of the recovery vessel and which is able to be raised and lowered to extend beyond the stern of the recovery vessel to lift and return the lifeboat to a cradle located between the stern of the vessel and the A-Frame.

Whilst such a lifting system as that disclosed in Australian Innovation Patent No. 2012100144 may be effective in recovering lifeboats or capsules in a timely and efficient manner, if there is a heavy sea, the means for engaging with the lifeboat or capsule, can be dangerous and time consuming. As a hook may weigh in the vicinity of 485 kg and the sling assembly that is attached to the lifeboat may weigh in the vicinity of 120 kg, such devices may be difficult to connect, even in calm seas. Further, in the event of a rough sea, any contact between an individual or the lifeboat/capsule and the devices can be dangerous. Hence, whilst the lifting device may be effective in lifting the lifeboat/capsule from the water for transport, considerable time can be wasted in actually hooking the lifeboat/capsule to the hoist system and/or in heavy seas it may simply not be possible to actually hook the lifeboat/capsule onto the hoist system, significantly delaying the critical recovery.

Thus, there is a need to provide a system and method for retrieving a vessel from water that is quick to capture and engage the vessel and which reduces or substantially ameliorates the likelihood of injury to all associated personnel during the attachment process.

The above references to and descriptions of prior proposals or products are not intended to be, and are not to be construed as, statements or admissions of common general knowledge in the art. In particular, the above prior art discussion does not relate to what is commonly or well known by the person skilled in the art, but assists in the understanding of the inventive step of the present invention of which the identification of pertinent prior art proposals is but one part.

STATEMENT OF INVENTION

The invention according to one or more aspects is as defined in the independent claims. Some optional and/or preferred features of the invention are defined in the dependent claims.

Accordingly, in one aspect of the invention there is provided a retrieval system for retrieving a vessel from water to a deck of a recovery vessel, comprising:

- a lifting device mounted on the deck of the recovery vessel, the lifting device comprising a substantially vertically extending structure and a lifting hook mounted to said substantially vertically extending structure so as to be raised and lowered therefrom by way of a first winch;
- a connection lead having a free end configured to detachably connect to a connection link of the vessel to be retrieved from the water an opposing end of the connection lead being located on the recovery vessel;
- a capture member mounted with respect to the lifting hook to capture the connection link of the vessel when the free end of the connection lead is raised towards the lifting hook; and
- a control member mounted with respect to the lifting hook of the lifting device and configured to receive at least a portion of the connection lead so as to direct the connection link to the capture member to be captured thereby as the free end of the connection lead is raised towards the lifting hook;
- wherein upon capture of the connection link by the capture member the winch is operated to facilitate lifting of the vessel from the water to the deck of the recovery vessel.

In one embodiment, the substantially vertically extending structure of the lifting device may comprise a frame structure. The frame structure may be an A-frame structure and the lifting hook may be mounted to a central portion of the A-frame structure.

In a preferred embodiment, the capture member and the control member may be formed into a body that is configured to be suspended from the lifting hook. The body may be substantially U-shaped to define a space into which the connection link may be captured by the capture member.

In this embodiment, the control member may comprise a sheave mounted within the space over which the connection lead may pass. A second winch may be mounted to the body and the opposing end of the connection lead may be connected to the second winch such that actuation of the second winch may cause the connection lead to travel over the sheave and raise the connection link into the space for capture by the capture member.

The capture member of this embodiment may comprise a locking pin mounted to one side of the body that is movable to extend across the space to engage with an opposing side of the body to capture the connection link. The locking pin may be movably connected to an actuator to facilitate movement of the locking pin between a first position whereby the locking pin extends across the space to close the space, and a second position whereby the locking pin is located remote from the space to open the recess. The actuator may be remotely controlled to capture the connection link for lifting of the vessel.

In an alternative embodiment, the connection lead may comprise a cable that is configured to pass over the control member. The control member may comprise a sheave mounted adjacent an opening of the lifting hook, over which the connection lead may pass so as to position the connection link adjacent the opening of the hook member In this alternative embodiment, the capture member may be a keeper member mounted to an end of the hook member to extend beyond the opening of the hook member and into the path of the connection line. The keeper member may be in the form of an elongate member having a wide end portion over which the connection lead may travel as the link is raised towards the body. The keeper member may be configured to penetrate the connection link as the connection link passes thereby so as to locate the connection link on the opening of the hook member. Following penetration of the keeper member into the connection link, the connection lead may be lowered to lower the link into the lifting hook for lifting of the vessel.

According to another aspect, the present invention provides a capture apparatus for capturing a link of a vessel to be retrieved from water, comprising:

- a body adapted to be mounted to a lifting device of a recovery vessel;
- a connection line configured to pass through said body and having a connector at one end for attachment to the link of the vessel to be retrieved;
- a control member mounted to said body for controlling the path of the connection line as it passes through said body so as to direct the link of the vessel to be retrieved into a capture position; and
- a capture member for securely capturing said link of the vessel to be retrieved for lifting from said water by the lifting device of the recovery vessel.

In an embodiment, the lifting device of the recovery vessel comprises a frame structure having a hook member extending therefrom which is raised and lowered from the frame structure by way of a winch.

The body may be adapted to be mounted to the hook member of the lifting device of the recovery vessel. In one form, the body may be configured to be suspended from the hook member of the lifting device of the recovery vessel.

In one embodiment, the body may be configured to have an inverted U-shape configuration that defines a central recess into which the link is to be captured. A locking pin may be mounted to one side of the body and may be movable to extend across the recess to engage with an opposing side of the body to capture the link. The locking pin may be movably connected to an actuator to facilitate movement of the locking pin between a first position whereby the locking pin extends across the recess to close the recess, and a second position whereby the locking pin is located remote from the recess to open the recess. The actuator may be remotely controlled.

The connection line may comprise a cable wound onto a winch. The winch may be mounted to the body and may be remotely actuable to raise and lower the cable. The control member may comprise a pulley about which the cable may pass, wherein the pulley may be located above the locking pin so as to position the link within the recess to be captured by the locking pin when the locking pin is moved to the first position.

In another embodiment of the present aspect of the invention, the control member may comprise a sheave mounted above an opening to the hook member.

In this embodiment, the connection line may be configured to pass over the sheave so as to position the link adjacent the opening of the hook member.

The capture member may be a keeper member mounted to an end of the hook member to extend beyond the opening of the hook member and into the path of the connection line. The keeper member may be in the form of an elongate member having a wide end portion over which the connection line may travel as the link is raised towards the body. The keeper member may be configured to penetrate the link as it passes thereby so as to locate the link on the opening of the hook member. Upon the keeper member penetrating the link, the connection line may be lowered to lower the link into the hook member for lifting.

According to another aspect, there is provided a system for retrieving a vessel from water, the vessel having a link for connection thereto, comprising:

a lifting device attachable to a recovery vessel, the lifting device comprising a frame structure and a hoist attachable to the frame structure for lifting the vessel from the water onto the recovery vessel by way of a lifting hook; and a capture apparatus according to the first aspect of the invention mounted to the lifting hook of the lifting device, the capture device being operable to initially raise and capture the link prior to the lifting device being operated to lift the vessel from the water and onto the recovery vessel.

According to yet another aspect, there is provided a method of retrieving a vessel from water, comprising:

positioning a recovery vessel adjacent the vessel to be retrieved, the recovery vessel having a lifting device comprising a frame structure, a hoist attachable to a lifting hook mounted on the frame structure, and a capture apparatus mounted to the lifting hook;

delivering a connection line of the capture apparatus to the vessel for attachment to a link of the vessel;

activating the capture apparatus to gather the collection line so as to deliver the link of the vessel to the lifting hook for capture; and activating the lifting device of the recovery vessel to lift the vessel from the water onto a deck of the recovery vessel, or a separate recovery vessel, for transportation.

According to yet another aspect, there is provided a system for retrieving a vessel from water, comprising:

a lifting device attachable to a recovery vessel and comprising a frame structure and a hoist attachable to the frame structure for lifting the vessel from the water onto the recovery vessel by way of a lifting hook;

a connection device independently operable with respect to said lifting device, the connection device comprising a connector provided at an end of an elongate body, the connector being configured to engage with a connection link provided on the vessel, the connection device being configured to operate by way of a sheave mounted to the lifting hook of the lifting device;

wherein, the connector of the connection device is initially provided to the vessel to engage with the connection link provided on the vessel and upon operation of the connection device the connection link of the vessel is brought into engagement with the lifting hook of the lifting device such that the lifting device can then be operated to lift the vessel from the water onto the recovery vessel for transportation purposes.

The elongate body of the connection device may be a rope or cable. The connection device may be operated by casting the rope or cable over the vessel such that the connector at the end of the rope or cable is located on the vessel. The connector may comprise a hook and loop fastener or a similar fastening device and may be manually engaged with the connection link of the vessel by way of an individual present on the vessel. In an alternative embodiment, the connector may be pre-attached to the connection link of the vessel, thereby obviating the need for an individual present on the vessel to be retrieved.

The connection device may be operated from the recovery vessel or from the vessel being recovered or from another vessel or platform by way of the application of a pulling force to the elongate body which is transferred to the connector and connection link via the sheave. The pulling force may cause the connector and the connection link to travel towards the sheave. The lifting hook of the lifting device may be configured such that as the connection link travels towards the sheave, the lifting hook captures the connection link.

The sheave may be mounted immediately above the opening of the lifting hook such that operation of the connection device causes the connection link to travel in a path directly over the opening of the lifting hook, without further manual positioning of the connection link.

According to another aspect of the present invention, there is provided a method of retrieving a vessel from water, comprising:

positioning a recovery vessel adjacent the vessel to be retrieved, the recovery vessel having a lifting device comprising a frame structure and a hoist attachable to a lifting hook mounted on the frame structure;

positioning the lifting device such that it extends over the vessel to be retrieved.

activating a capture apparatus to lower a connection lead from the lifting device to an individual located on the vessel to be retrieved;

connecting an end of the connection lead to connection link of the vessel to be retrieved;

retracting the connection lead so as to raise the connection link towards a capture device associated with the lifting device;

activating the capture device to capture the connection link as the connection link is brought into close proximity thereto; and activating the lifting device to lift the vessel from the water onto a deck of the recovery vessel for transportation.

BRIEF DESCRIPTION OF THE DRAWINGS

The invention may be better understood from the following non-limiting description of preferred embodiments, in which.

DETAILED DESCRIPTION OF THE DRAWINGS

Preferred features of the present invention will now be described with particular reference to the accompanying drawings. However, it is to be understood that the features illustrated in and described with reference to the drawings are not to be construed as limiting on the scope of the invention.

The system and method of the present invention will be described below in relation to its application for use in retrieving a Self-Propelled Hyperbaric Lifeboat (SPHL) from sea. However, it will be appreciated that the present invention may also have applications for use in the retrieval of a variety of vessels from water, including other types of lifeboats, boats or capsules, as will be appreciated by those skilled in the art.

Figure 1:
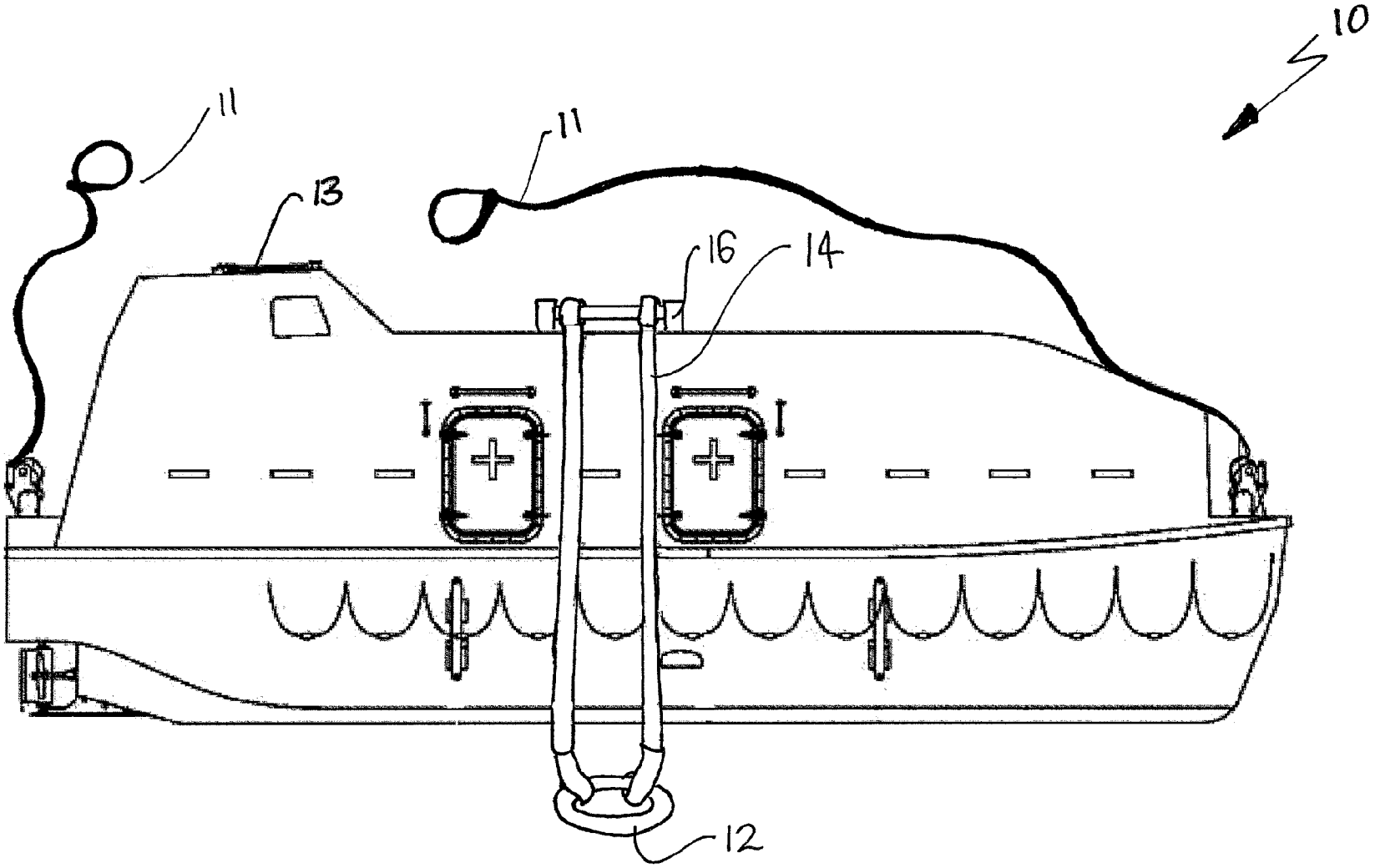
FIG. 1 is a side view of a lifeboat vessel for retrieval by the system and method of the present invention.

Referring to FIG. 1, a lifeboat 10 in accordance with an embodiment of the present invention is depicted. The lifeboat 10 is preferably a SPHL capable of maintaining one or more individuals at a saturation pressure for a predetermined period of time, and is able to be controlled by one or more individuals who are not maintained at an elevated pressure. Such an individual is typically referred to as a coxswain and is able to enter the vessel by way of hatch 13.

The vessel 10 generally comprises a mount 16 which is attached to an upper portion of the vessel 10 in a central region thereof. The mount 16 provides a point where the vessel 10 is able to be lifted by a lifting system of a recovery vessel, in the manner as will be described in more detail below. It will be appreciated that the means for attachment to the vessel 10 may vary depending on the type of vessel being recovered and the connection devices carried by the vessel. The present invention will be described below in relation to a conventional masterlink type connection. However, in an alternative form the vessel may have two connection elements for connecting to the stern of the vessel and the bow of the vessel.

A sling 14 is attached to the mount 16 and is in the form of a pair of flexible straps that may comprise ropes, chains or cables which may be enclosed within an outer coating of durable material. The slings 14 are each attached at their distal ends to a link 12, which is in the form of a closed metal ring that is configured to engage with a hook member of the lifting device of the recovery vessel in the manner as will be described in more detail below. A pair of tag lines 11 are each attached to the bow and stern of the vessel 10 and secured adjacent the hatch for access by the coxswain as required.

Figure 2:
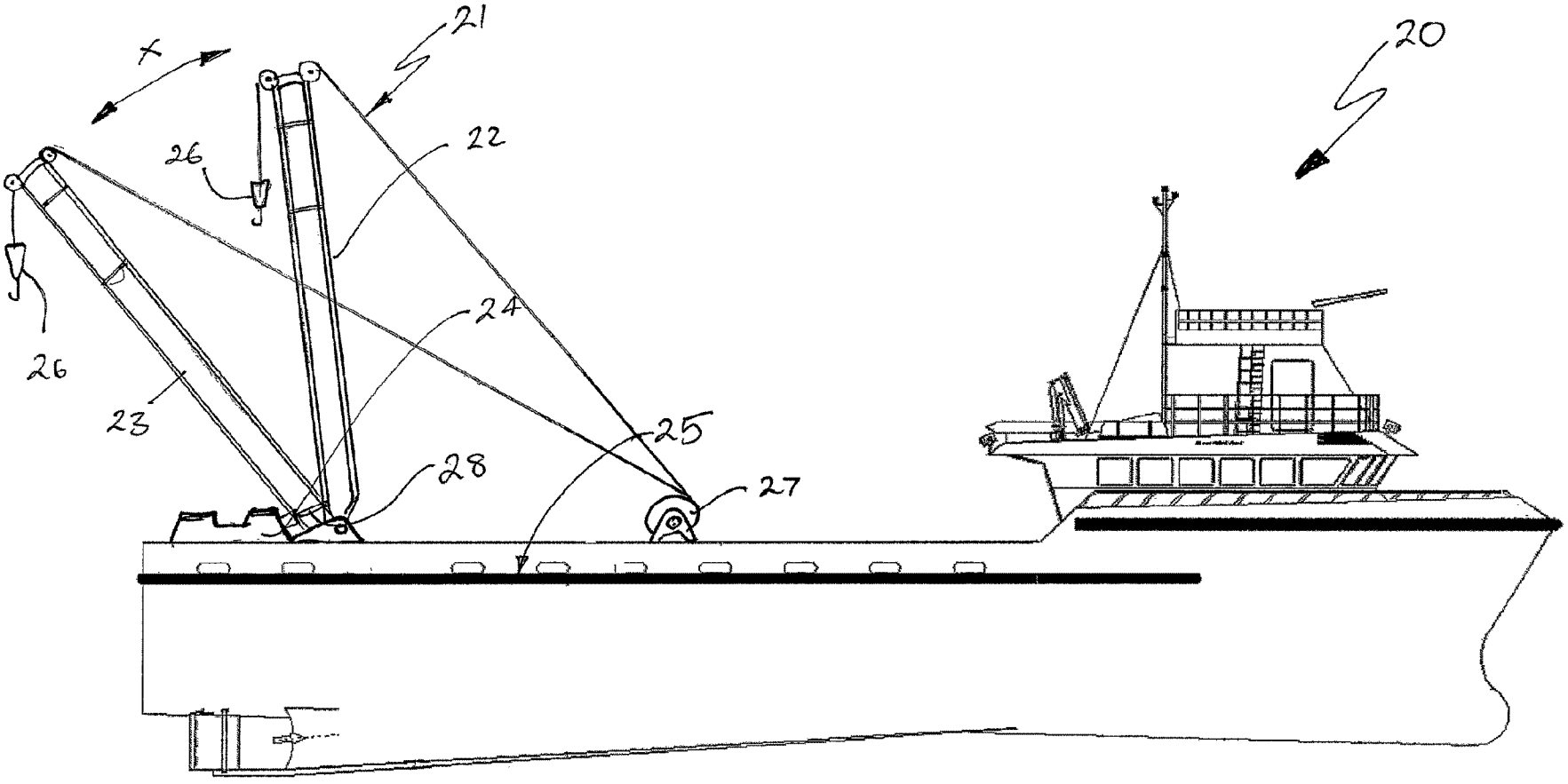
FIG. 2 is a side view of a recovery vessel for retrieving the lifeboat vessel of FIG. 1 in accordance with an embodiment of the system and method of the present invention.

An embodiment of a recovery vessel 20 is depicted in FIG. 2. The recovery vessel 20 is similar to that which is described in the Applicant's earlier Australian Innovation Patent No. 2012100144 and comprises a deck 25 having a lifting device 21 mounted adjacent the stern thereof. The lifting device 21 comprises an A-Frame structure comprising a pair of legs 23 connected together at their upper ends to form an A-shape. The legs 23 are connected at their base to actuators 28 that are able to impart rotational motion to the A-frame structure 22 to move the A-frame structure 22 in the direction of arrow 'X', between a substantially upright position and a lowered position. The actuators 28 are also able to return the A-frame structure 22 from the lowered position to the substantially upright position.

A hook 26 is mounted to extend from an upper or horizontal portion of the A-frame structure 22 and is controllable by a winch 27 to be lowered and raised in a manner as will be described in more detail below. The hook 26 in association with the winch 27 provides a means by which the vessel 10 is able to be lifted and positioned on a cradle 24 of the recovery vessel. The cradle 24 is configured to securely receive the vessel when it is retrieved from the water and is located between the stern, or water side, of the recovery vessel 20 and the base of the A-frame structure, as depicted.

It will be appreciated that the manner in which the lifting device 21 of the present invention is controlled to lift a lifeboat 10 from the water is described and discussed in detail in the Applicant's earlier Australian Innovation Patent No. 2012100144, which is incorporated in its entirety herein by reference. No further descriptive detail will be provided for the lifting device 21 in accordance with the present invention.

It will also be appreciated that the configuration of the recovery vessel 20 may also vary from that shown in FIG. 2. In this regard and as will be depicted in the embodiment below, the recovery vessel 20 may be configured such that the lifting device 21 may be located adjacent the port or starboard side of the recovery vessel, as opposed to the stern of the vessel.

Figure 3:
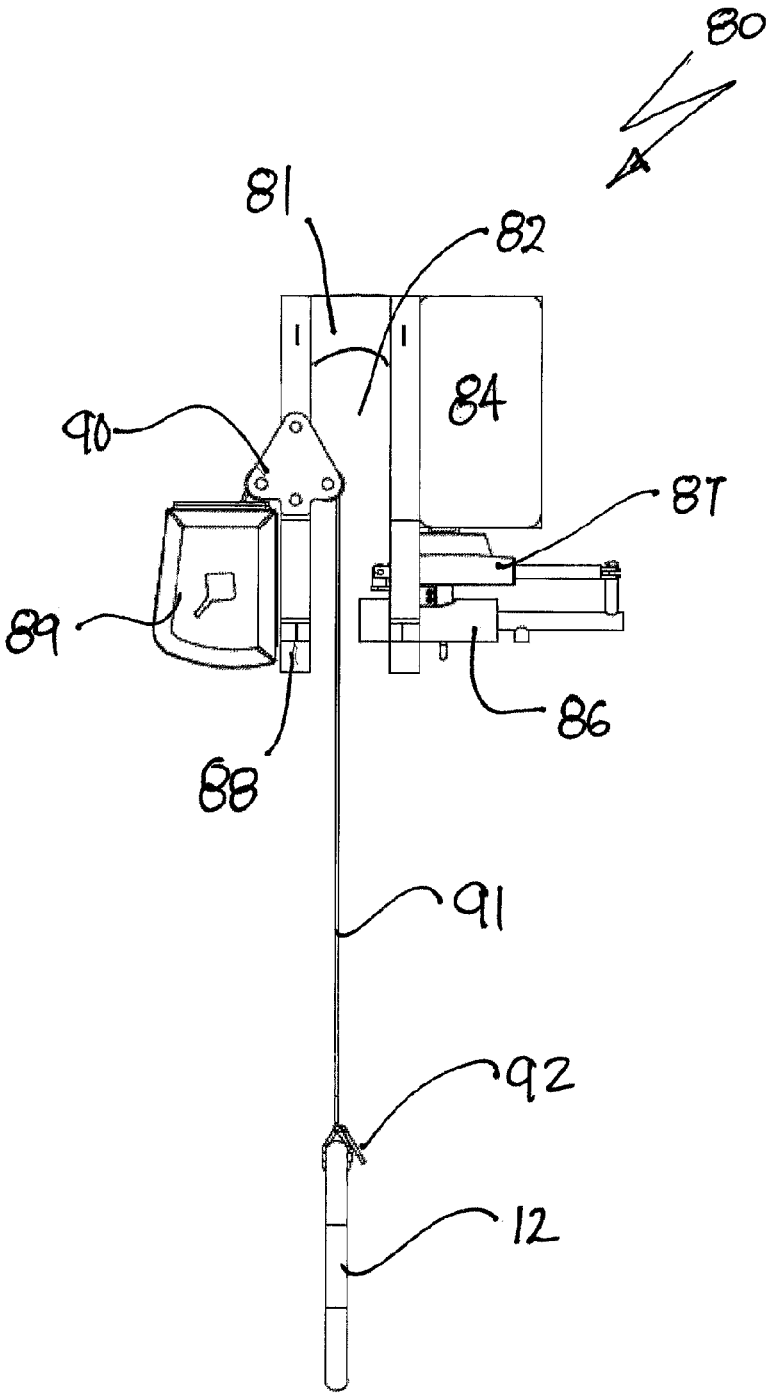
FIG. 3 is a front view of a capture device in accordance with an embodiment of the present invention.
Figure 4:
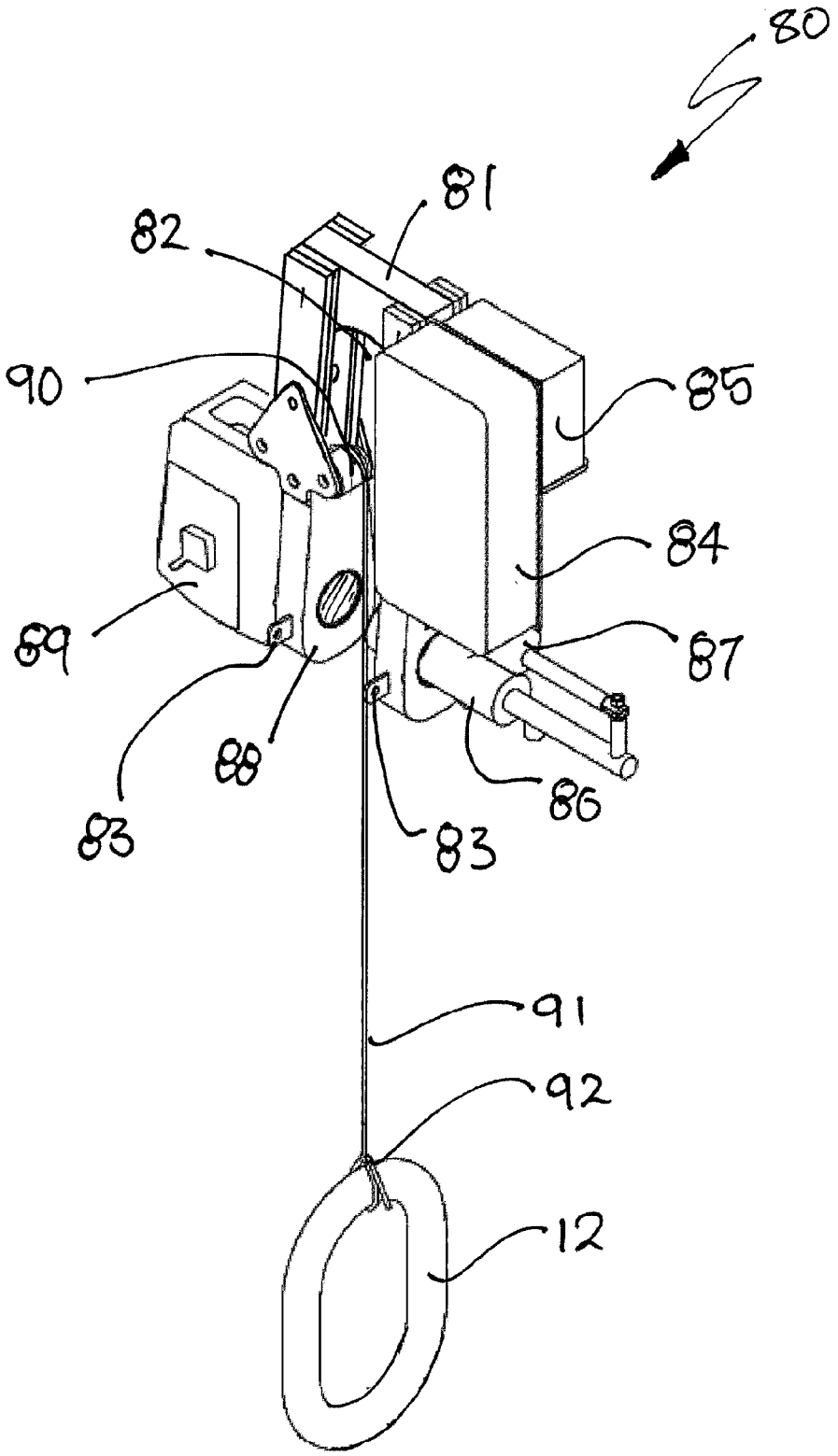
FIG. 4 is a perspective view of the capture device of FIG. 3.
Figure 5:
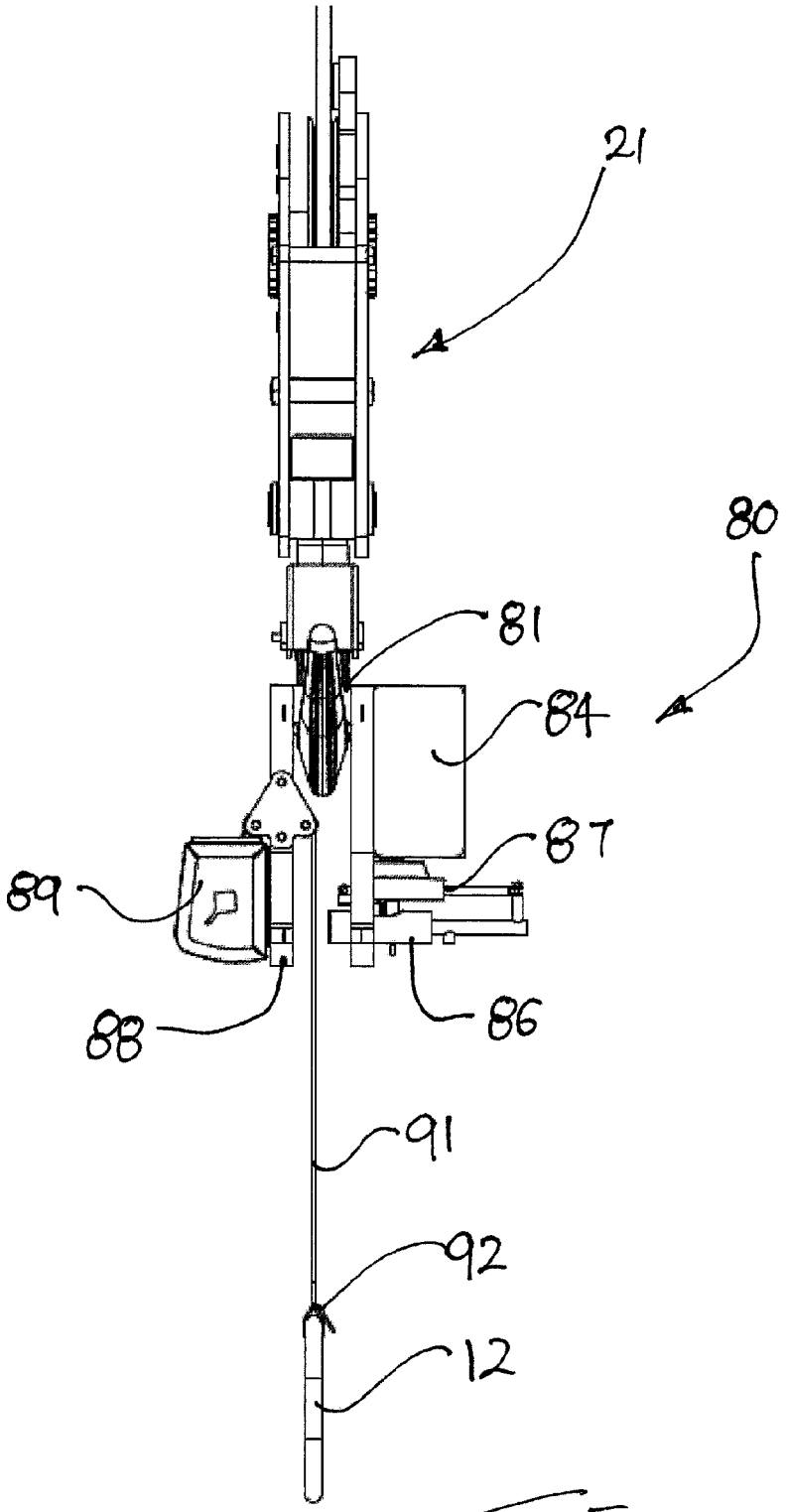
FIG. 5 is a front view of the capture device of FIG. 3 mounted for use on a hook member of a lifting device.
Figure 6:
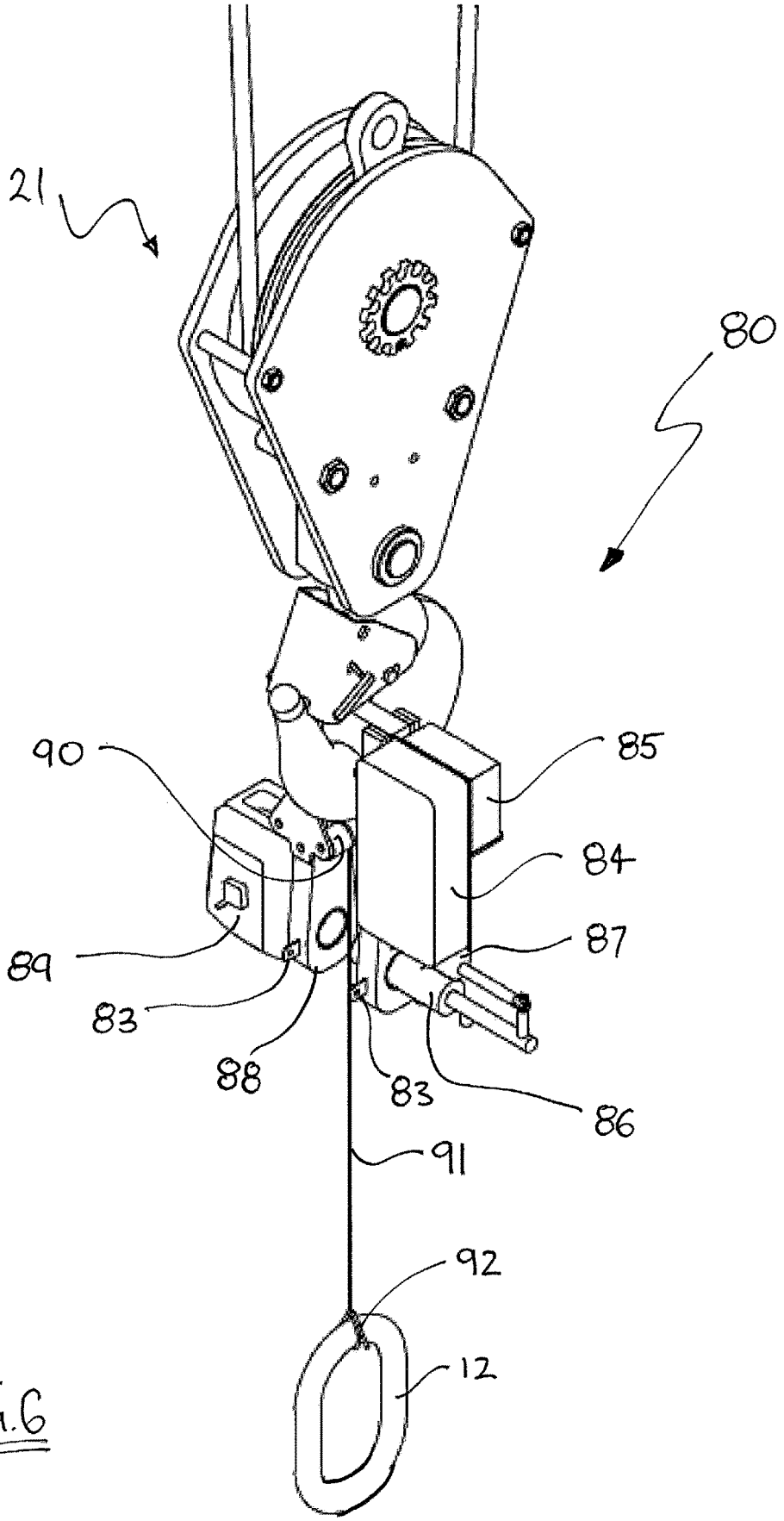
FIG. 6 is a perspective view of the capture device of FIG. 5.

Referring to FIGS. 3 and 4, a capture device 80 in accordance with an embodiment of the present invention is depicted. The capture device 80 is configured to be used with a conventional hook for a hoist or the like, as is commonly used in marine applications. The capture device 80 is in the form of a substantially U-shaped body having a central recess 82 that is configured to receive the hook such that the capture device 80 can be suspended therefrom in the manner as shown in FIG. 5 and FIG. 6.

On one side of the capture device 80 there is provided a controller 84 that contains an electronic circuit for controlling the operation of the device 80. The electronic circuit may comprise a microprocessor and appropriate electronic circuitry for powering and controlling the overall function of the components of the device 80 in a manner as will be described in more detail below. The controller 84 may house a power supply or similar arrangement for supplying power to the various components of the device, alternatively, power may be supplied to the controller 84 from an external source, as will be appreciated by those skilled in the art.

A receiver/transmitter 85 is mounted to the controller 84 and comprises electronic circuitry capable of receiving and decoding remote control signals from a remote controller to operate the various components of the device 80. The receiver/transmitter may also transmit signals about the status and operating condition of the device 80 to the remote controller for improved control and feedback purposes.

A locking pin 86 is mounted adjacent the underside of the device 80 and is controllable by an actuator device 87 to move the locking pin 86 between an open position as depicted in FIGS. 3 and 4, and a closed position where the locking pin 86 extends across the recess 82 to engage with a keeper member 88. The actuator device 87 is in the form of an electromagnetic device for controlling movement of the locking pin under direction of the controller, which may be receiving instructions from a remote controller via the receiver/transmitter 85. In an alternative form, the actuator device may be a hydraulic or pneumatic device.

On the opposing side of the recess 82 of the device 80, there is provided a winch 89 for lowering and raising a cable 91. The cable 91 extends from the winch housing 89 and over a pulley 90 to travel between the recess 82 of the device 80 along one side of the keeper member 88 so as not to prevent the locking pin 86 from engaging with the keeper member 88. The distal end of the cable 91 is provided with a securing means 92, such as a Velcro end portion, to facilitate engagement of the cable 91 with the link 12 of the sling 14 of the vessel 10. The winch 89 is controlled by the controller 84, which can receive signals from a remote controller via the transmitter/receiver 85. A pair of position sensors 83 are positioned on either sides of the recess 82. The position sensors may be in the form of electromagnetic sensors to determine the position/location of the link 12 with respect to the device 80 in a manner as to be described in more detail below. The position sensors 83 may alternatively be optical sensors which detect the presence/location of the link 12 and provide a signal to the controller 84 as to whether the link 12 has been detected or not.

The upper region of the device 80 extending between the opposing sides of the device 80 is provided with a bridge 81. The bridge 81 has a curved profile that matches the upper surface of the hook of the lifting device 21 such that when the device 80 is located within the hook of the lifting device 21, it is securely retained in position, in a substantially stable manner where movement between the device 80 and the hook is minimised. This is depicted in FIGS. 5 and 6.

As will be discussed in more detail below, the capture device 80 of the present embodiment is configured to provide a safe and effective means for capturing and retrieving the link 12 of the vessel 10 to facilitate lifting and retrieval of the vessel 10, even in the presence of rough seas and large swell.

The manner in which the capture device of the present embodiment functions to achieve this result will be described in more detail below.

Figure 7A:
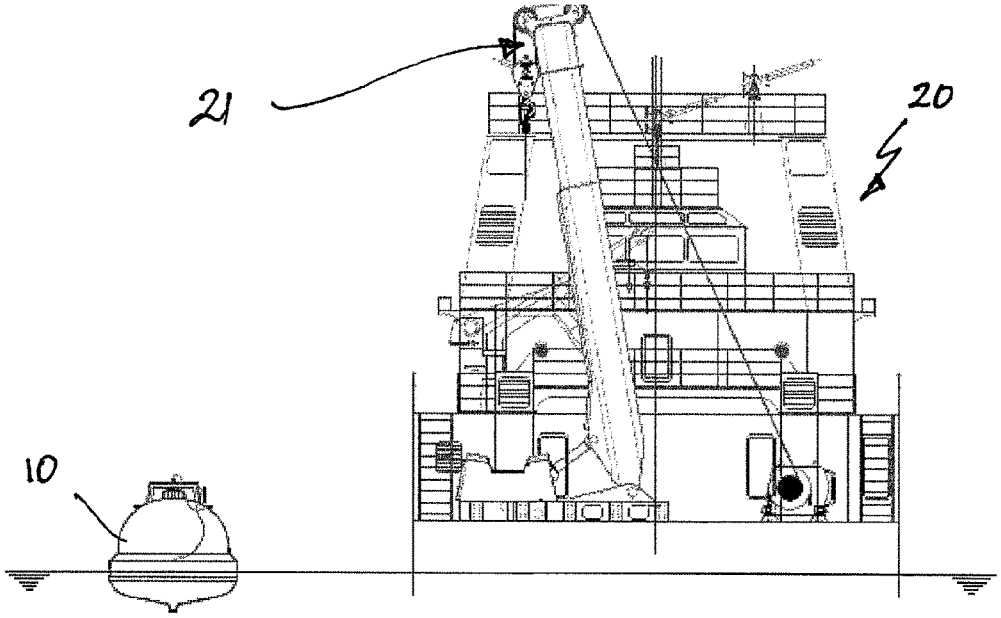
FIGS. 7A and 7B are end and top views respectively of a recovery vessel preparing to retrieve a lifeboat vessel in accordance with a step of retrieving a lifeboat vessel in accordance with the present invention.
Figure 7B:
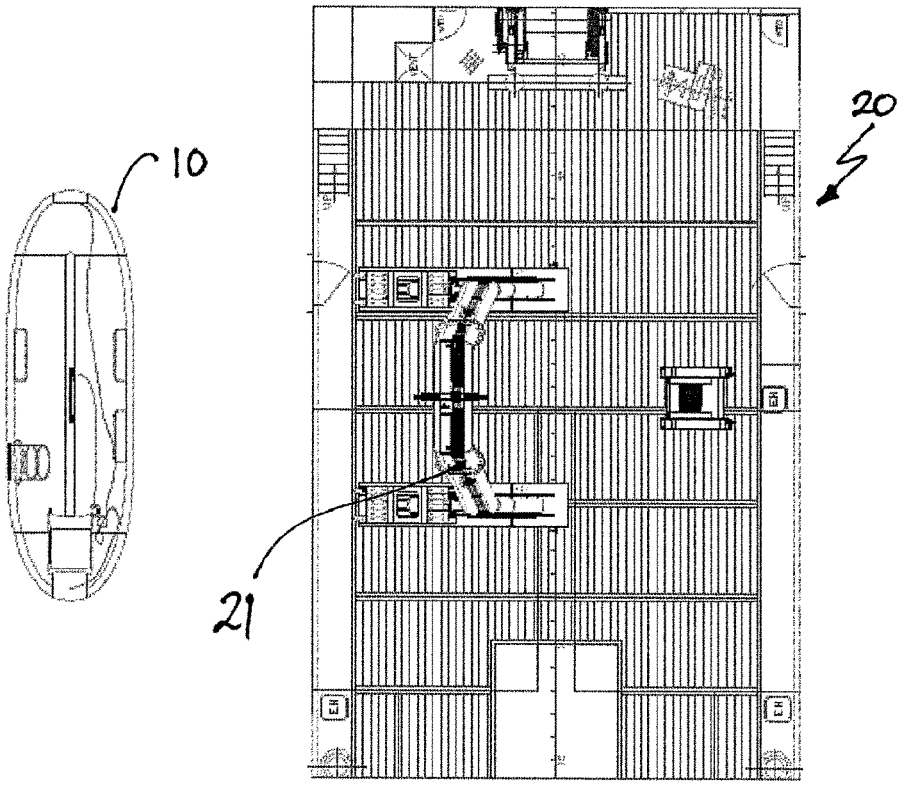

Referring to FIGS. 7A and 7B, in order to retrieve the vessel 10 the recovery vessel 20 is positioned alongside the vessel 10 such that the vessel 10 is located adjacent the lifting device 21. In this embodiment, the lifting device 21 is positioned adjacent the port side of the recovery vessel 20 and the recovery vessel is positioned optimally taking into consideration the weather conditions.

Figure 8A:
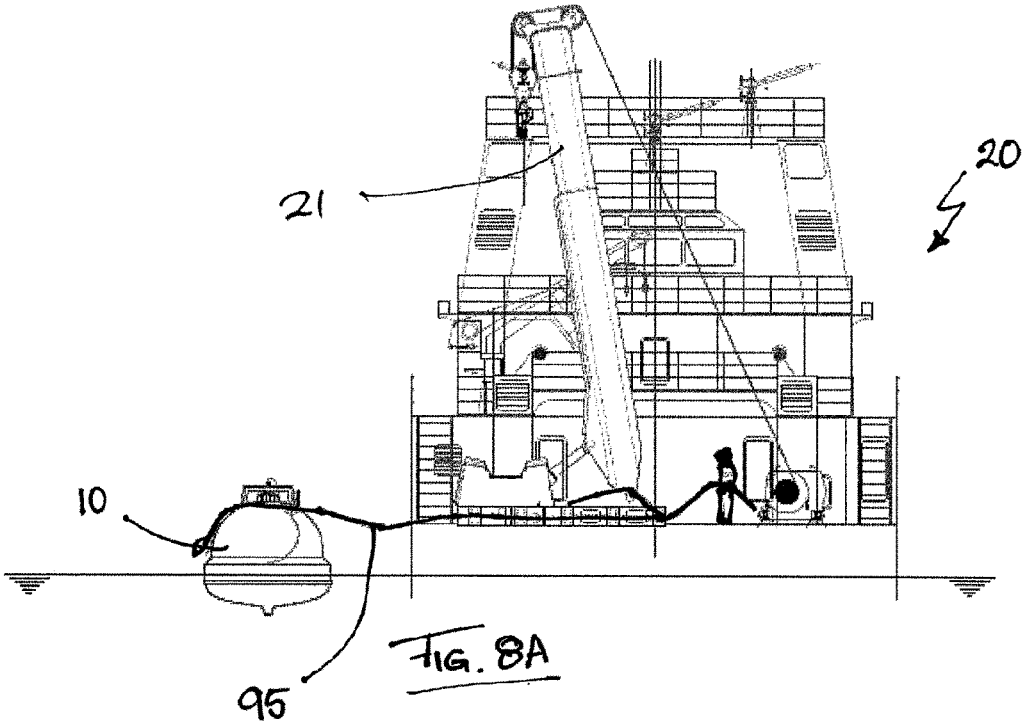
FIGS. 8A and 8B are end and top views respectively of a recovery vessel preparing to retrieve a lifeboat vessel in accordance with another step of retrieving a lifeboat vessel in accordance with the present invention.
Figure 8B:
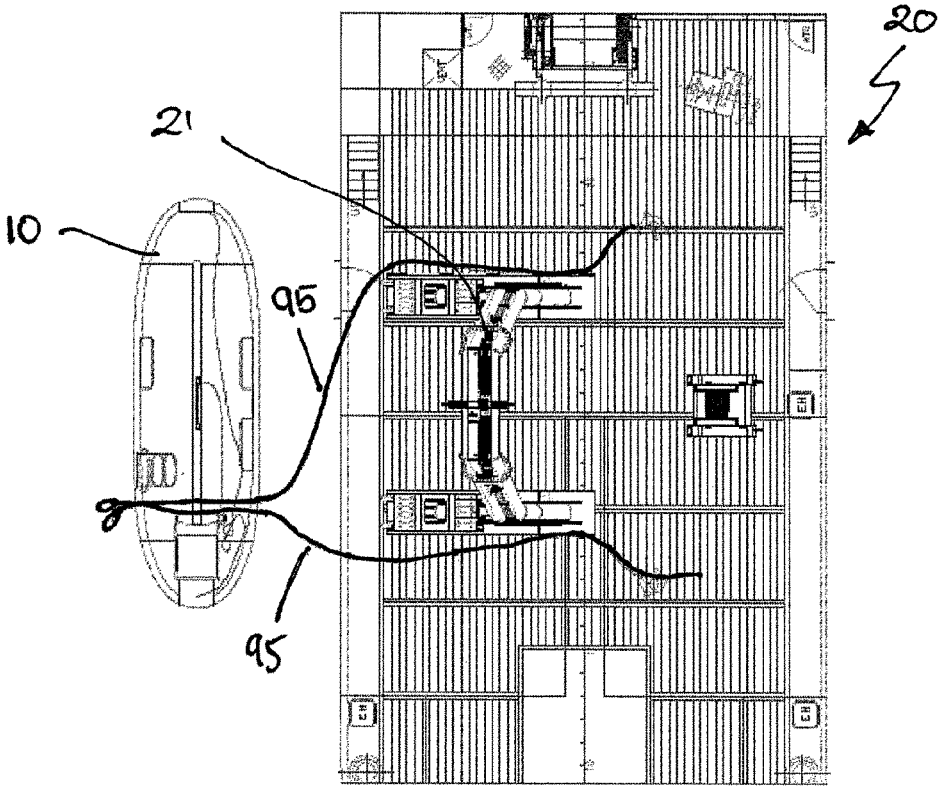
Figure 9A:
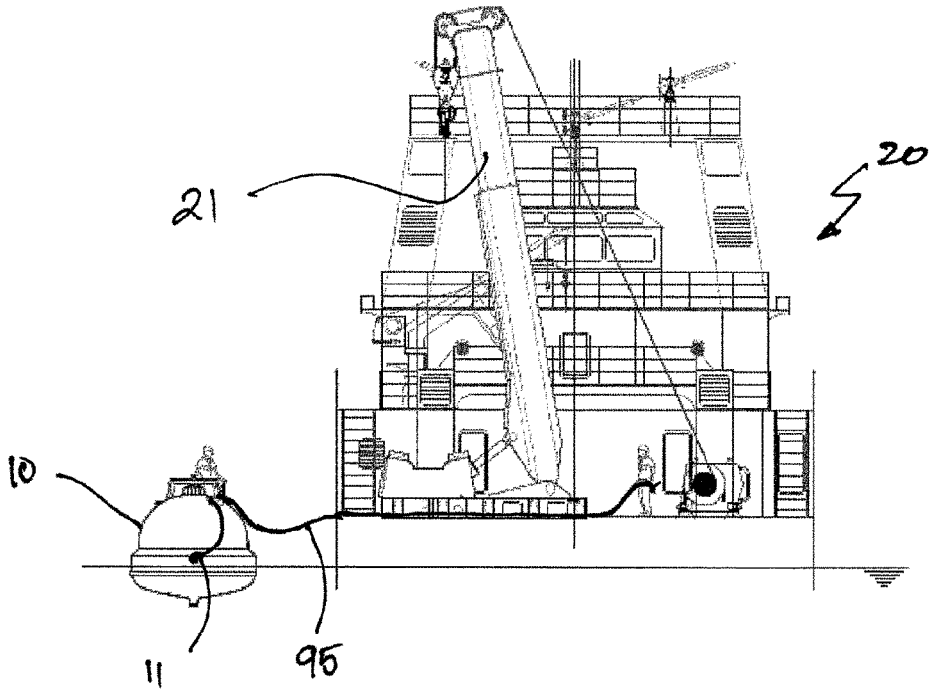
FIGS. 9A and 9B are end and top views respectively of a recovery vessel preparing to retrieve a lifeboat vessel in accordance with another step of retrieving a lifeboat vessel in accordance with the present invention.
Figure 9B:
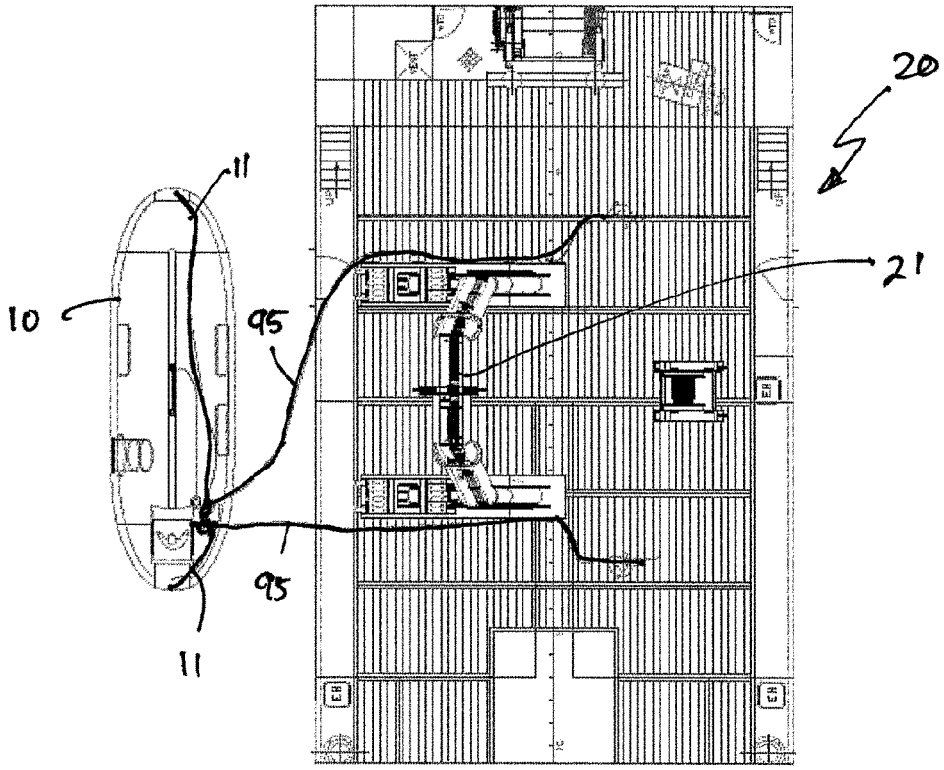
Figure 10A:
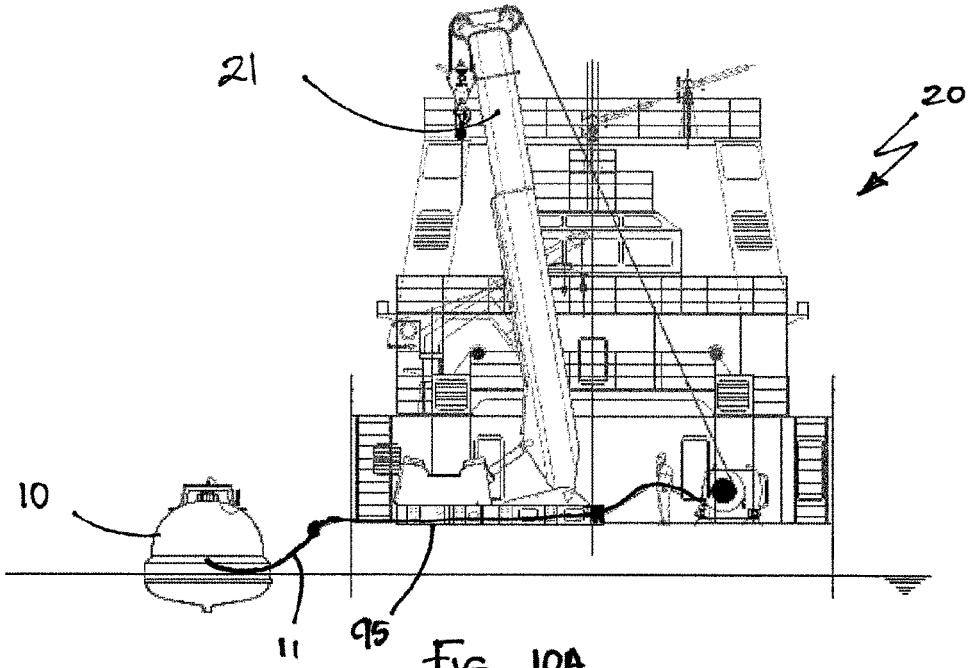
FIGS. 10A and 10B are end and top views respectively of a recovery vessel preparing to retrieve a lifeboat vessel in accordance with another step of retrieving a lifeboat vessel in accordance with the present invention.
Figure 10B:
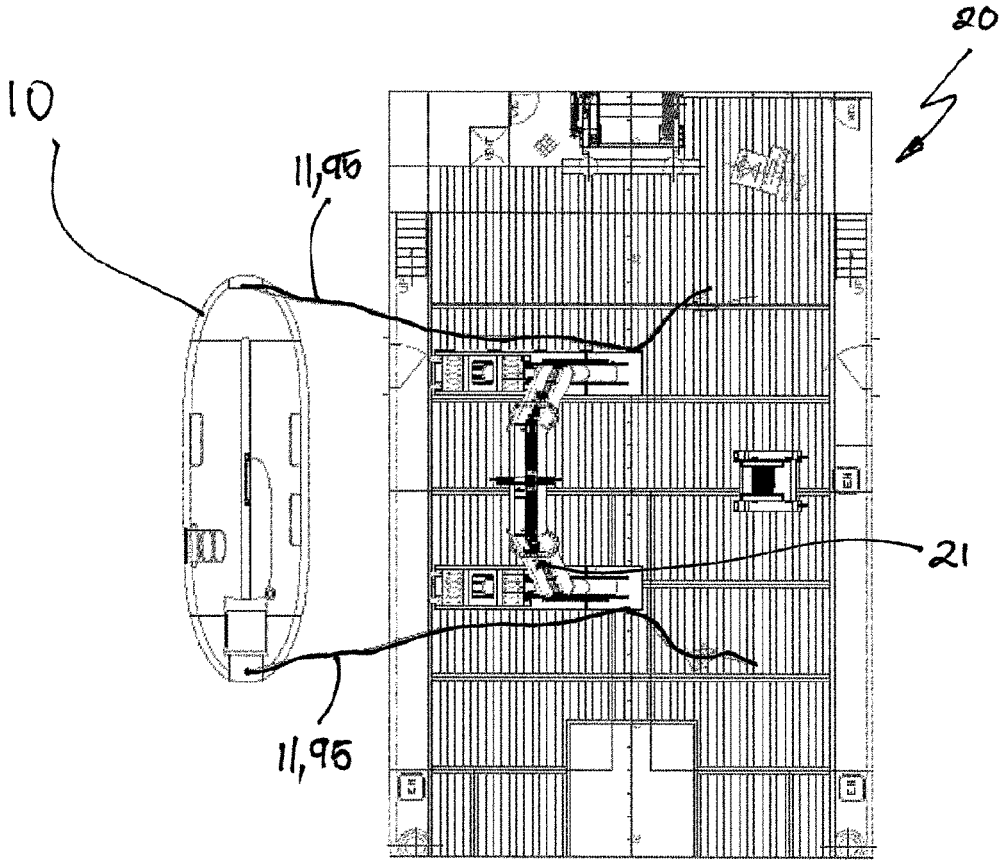

As is shown in FIGS. 8A and 8B, the crew of the recovery vessel 20 then throw tag lines 95 over the vessel 10 to be gathered by the coxswain present on the vessel 10. As is depicted in FIGS. 9A and 9B, the coxswain then connects the taglines 95 to the taglines 11 of the vessel 10 and the crew on the recovery vessel 20 then loop the end of the taglines 95 through shackles provided on the base of the lifting device 21 in the manner as shown in FIGS. 10A and 10B.

Figure 11A:
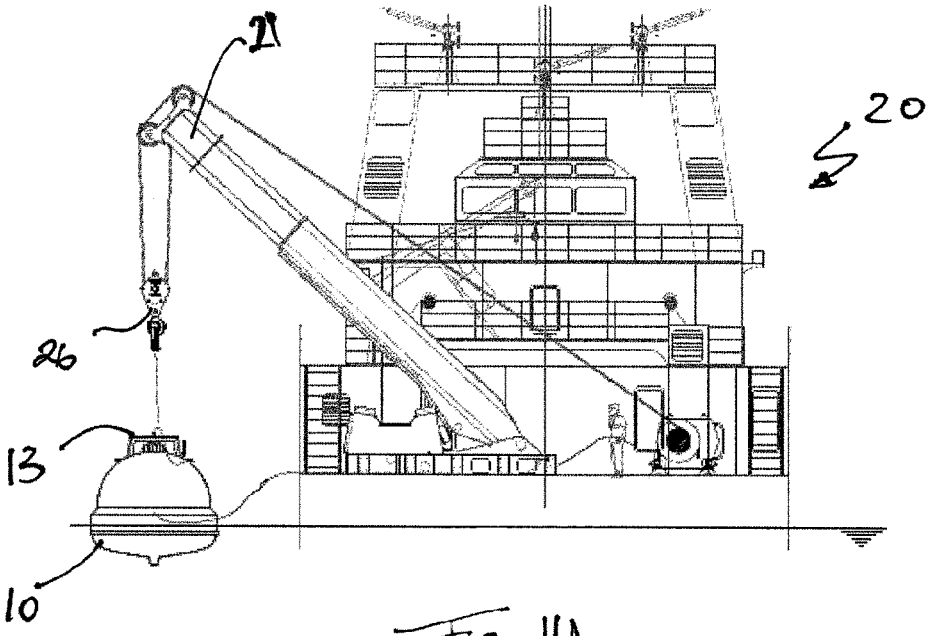
FIGS. 11A and 11B are end and top views respectively of a recovery vessel preparing to retrieve a lifeboat vessel in accordance with another step of retrieving a lifeboat vessel in accordance with the present invention.
Figure 11B:
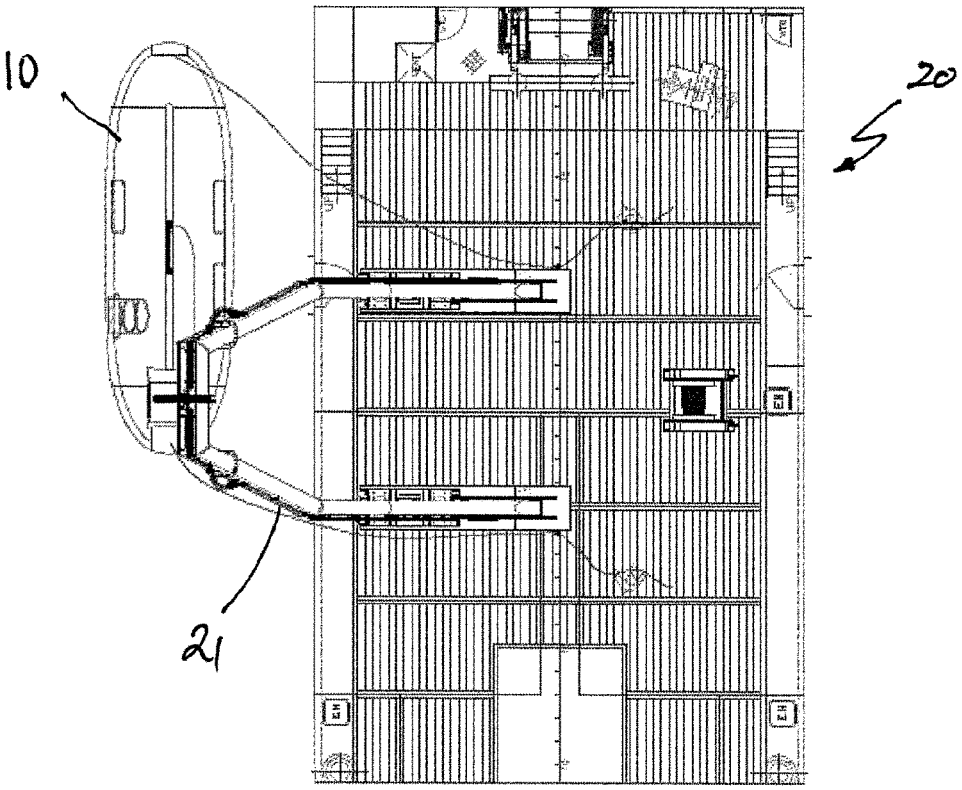

With the tag lines secured, the vessel 10 is then allowed to move forward such that the hook 26 of the lifting device 21 of the recovery vessel is located over the hatch 13 of the vessel 10, where the coxswain is located, as shown in FIGS. 11A and 11B. In this position, the crew of the recovery vessel 20 can lower the A-Frame of the lifting device over the coxswain and, via their remote control device, activate the winch 89 of the capture device 80 located at the end of the hook 26, to lower the cable 91 to the coxswain present in the vessel 10.

Figure 12A:
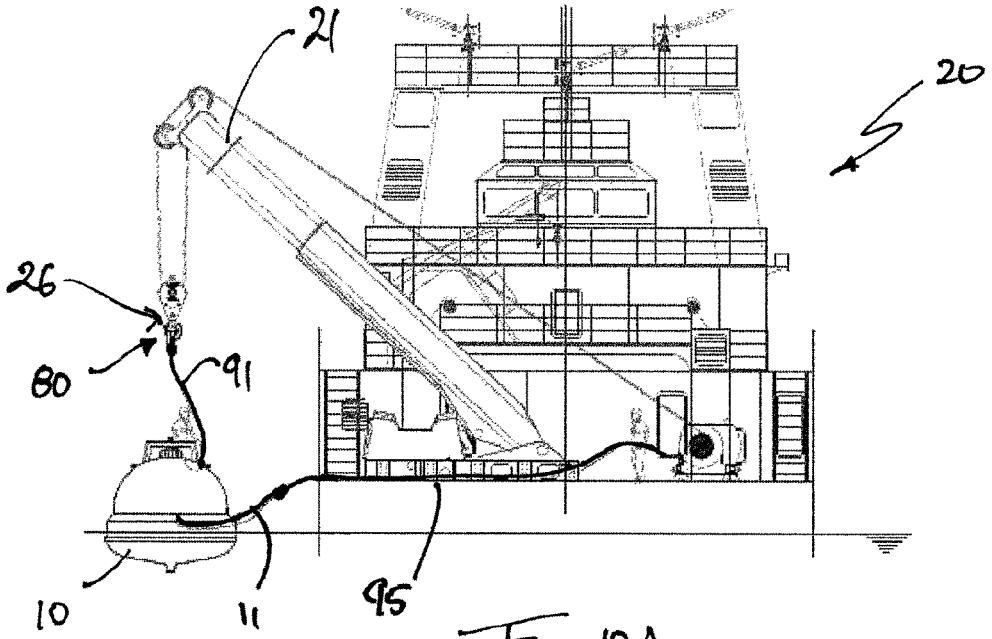
FIGS. 12A and 12B are end and top views respectively of a recovery vessel preparing to retrieve a lifeboat vessel in accordance with another step of retrieving a lifeboat vessel in accordance with the present invention.
Figure 12B:
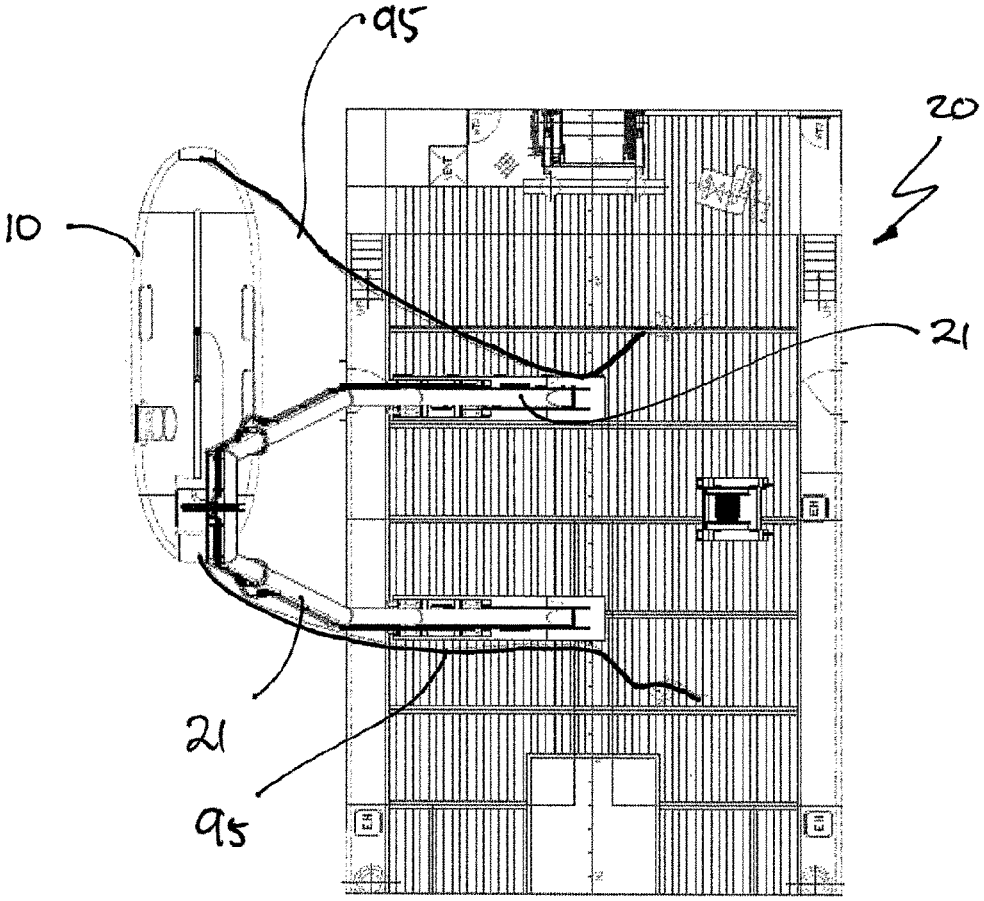
Figure 13A:
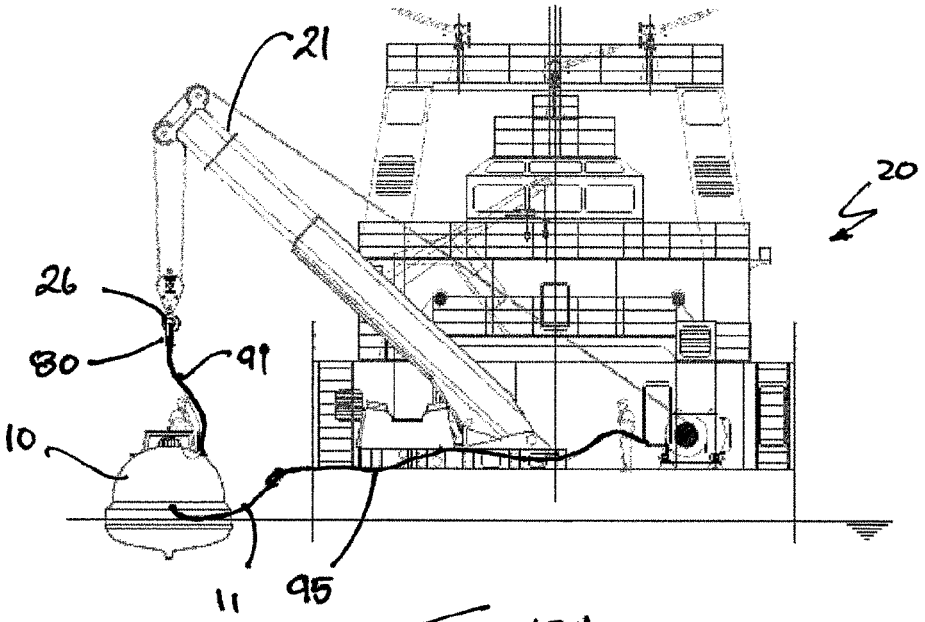
FIGS. 13A and 13B are end and top views respectively of a recovery vessel preparing to retrieve a lifeboat vessel in accordance with another step of retrieving a lifeboat vessel in accordance with the present invention.
Figure 13B:
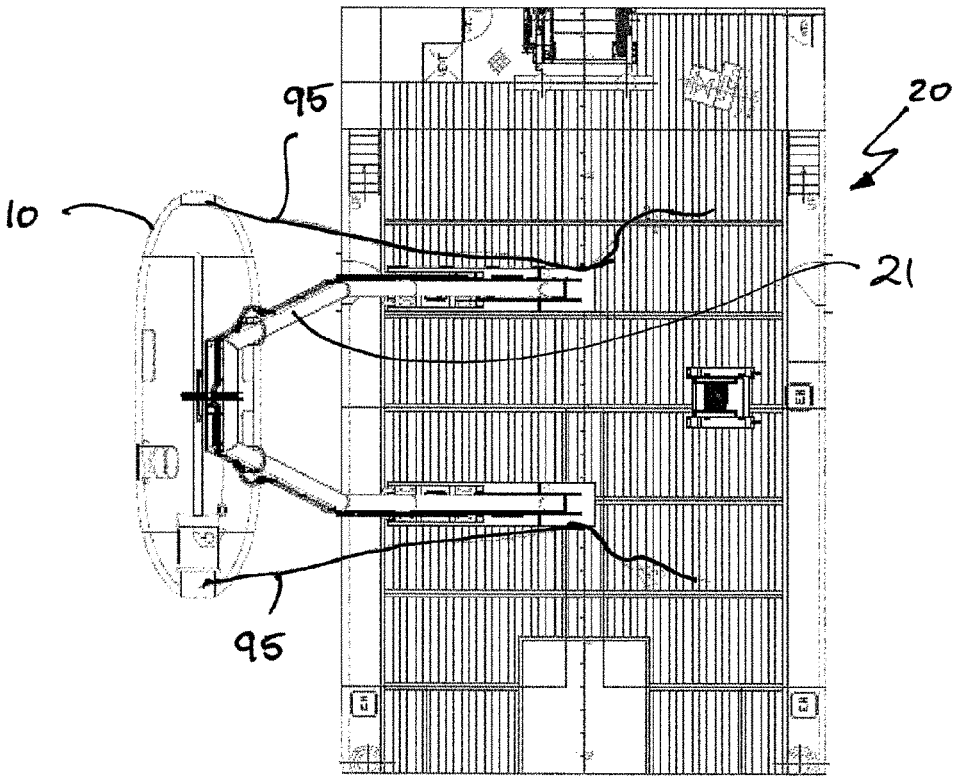

As is shown in FIGS. 12A and 12B, the coxswain is then able to connect the securing means 92 of the cable 91 to the link 12 of the lifting sling 14 of the vessel 10. At this stage, the vessel 10 is caused to move in an aft direction such that the vessel 10 is located centrally below the lifting device 21 for lifting, as is shown in FIGS. 13A and 13B.

Figure 14:
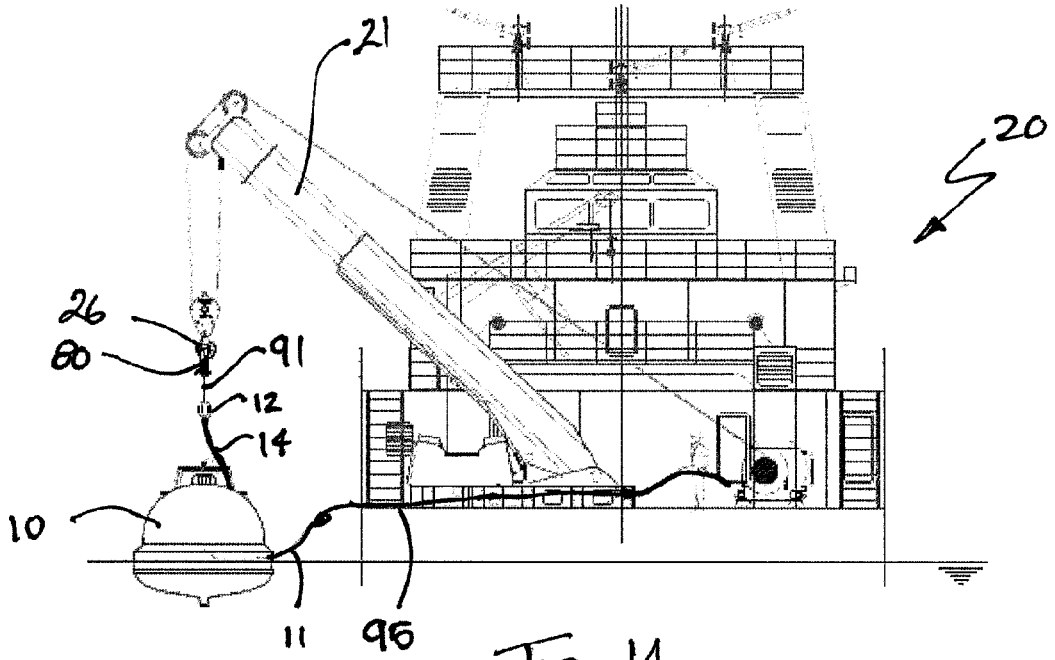
FIGS. 14 and 15 are end views of a recovery vessel preparing to retrieve a lifeboat vessel in accordance with another step of retrieving a lifeboat vessel in accordance with the present invention.
Figure 15:
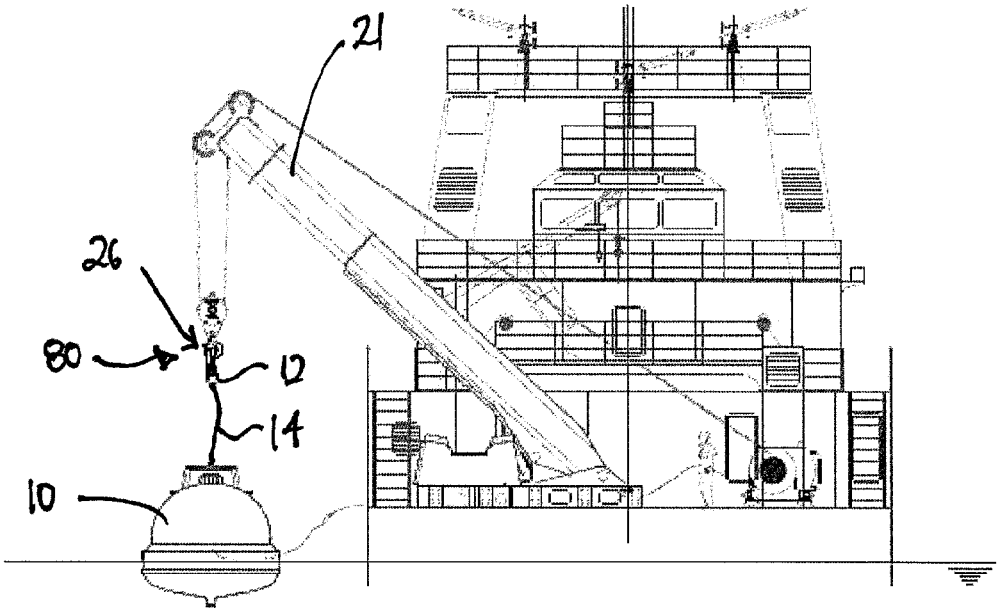
Figure 16:
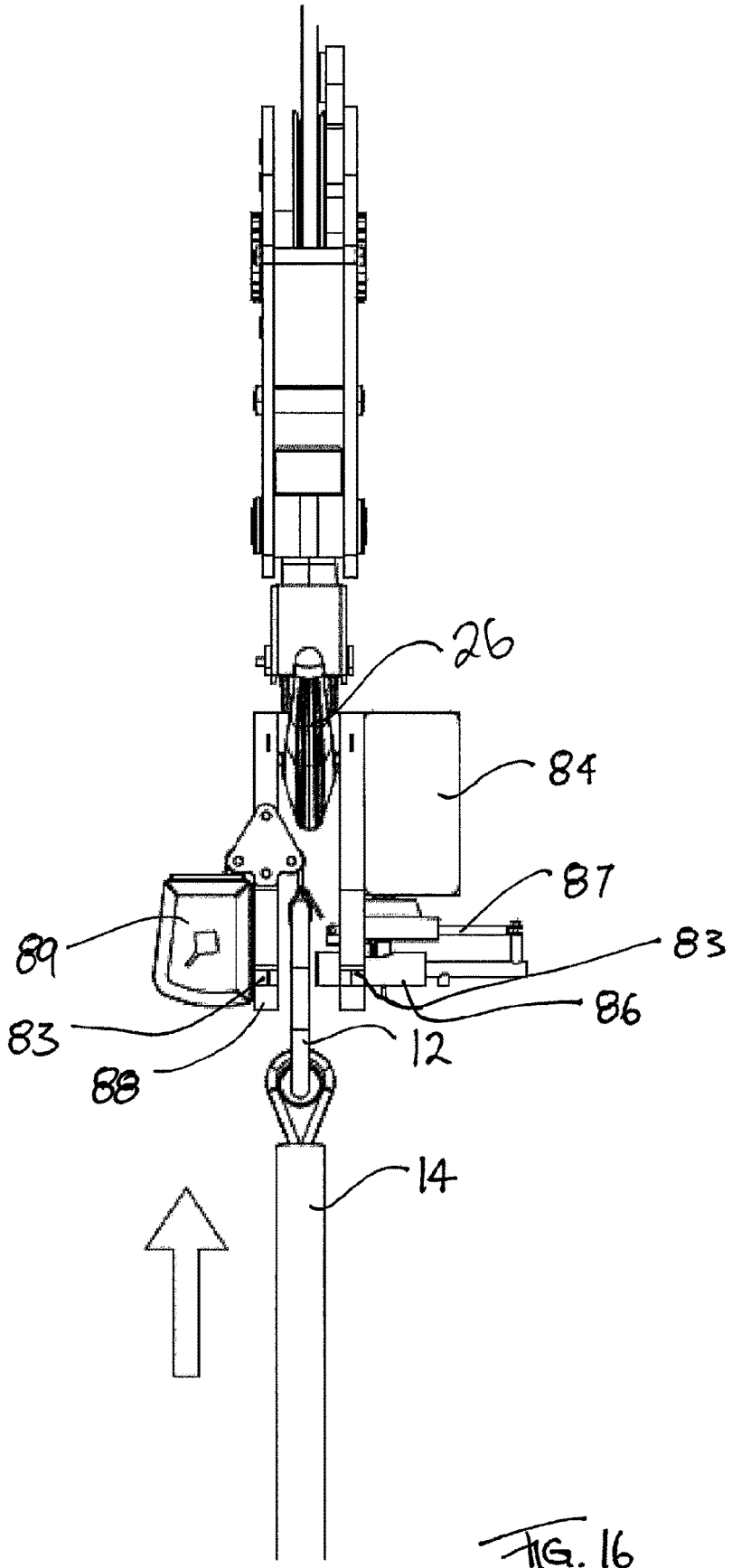
FIG. 16 is a front view of the capture device of FIG. 3 in a position where the link of the connection means of the lifeboat vessel is raised for capture.
Figure 17:
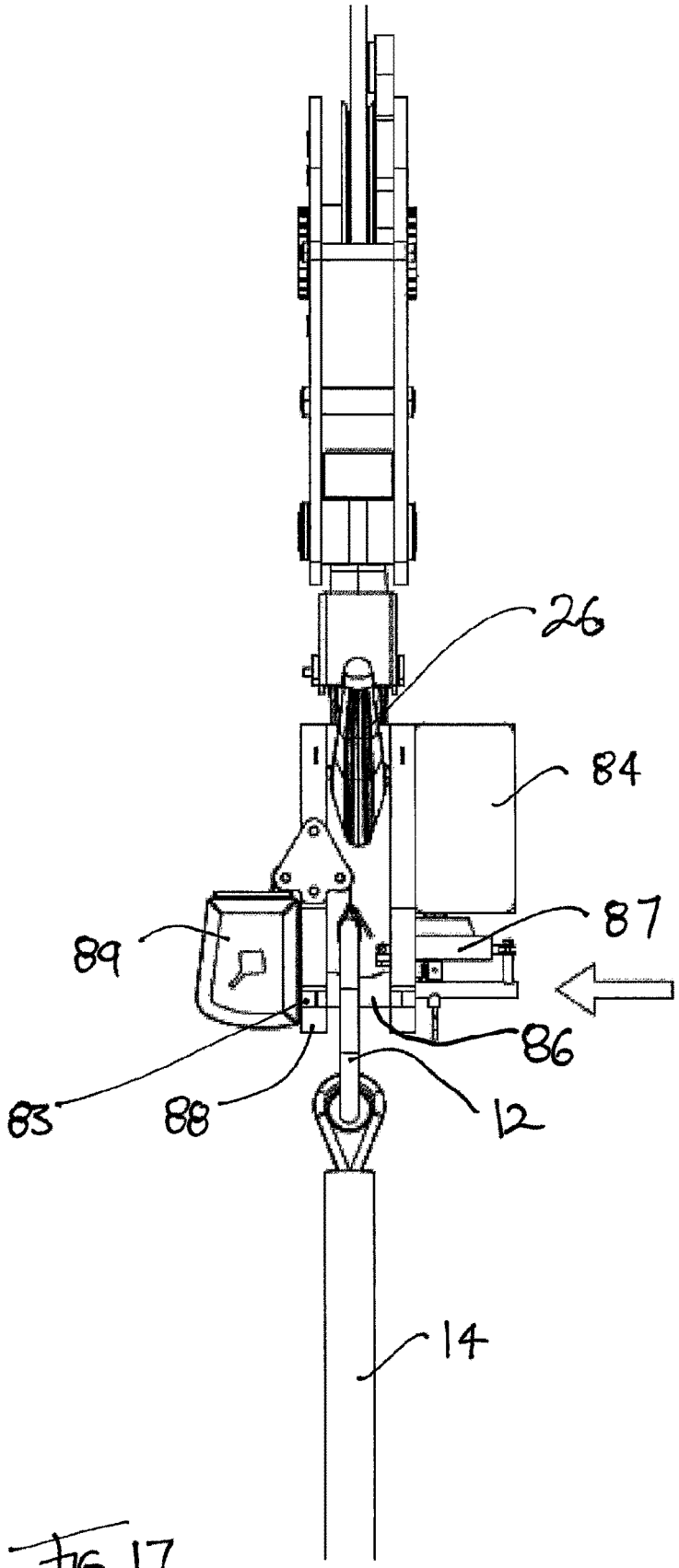
FIG. 17 is a front view of the capture device of FIG. 3 in a position where the link of the connection means of the lifeboat vessel is captured.

In FIGS. 14 and 15, the crew present on the recovery vessel 20, via a remote control unit, actuate the winch 89 of the capture device 80 such that the link 12 of the sling of the vessel 10 is raised towards the capture device 80 present on the hook 26. The winch 89 continues to raise the cable 91 until the sensor elements 83 detect the presence of the link 12, indicating that the link 12 has been raised above the level of the locking pin 86, as depicted in FIG. 16. The winch 89 then stops and the actuator device 87 is activated thereby causing the locking pin 86 to extend across the recess 82 to engage within the keeper member 88 as shown in FIG. 17. This captures the masterlink 12 of the lifting sling of the vessel 10.

Figure 18:
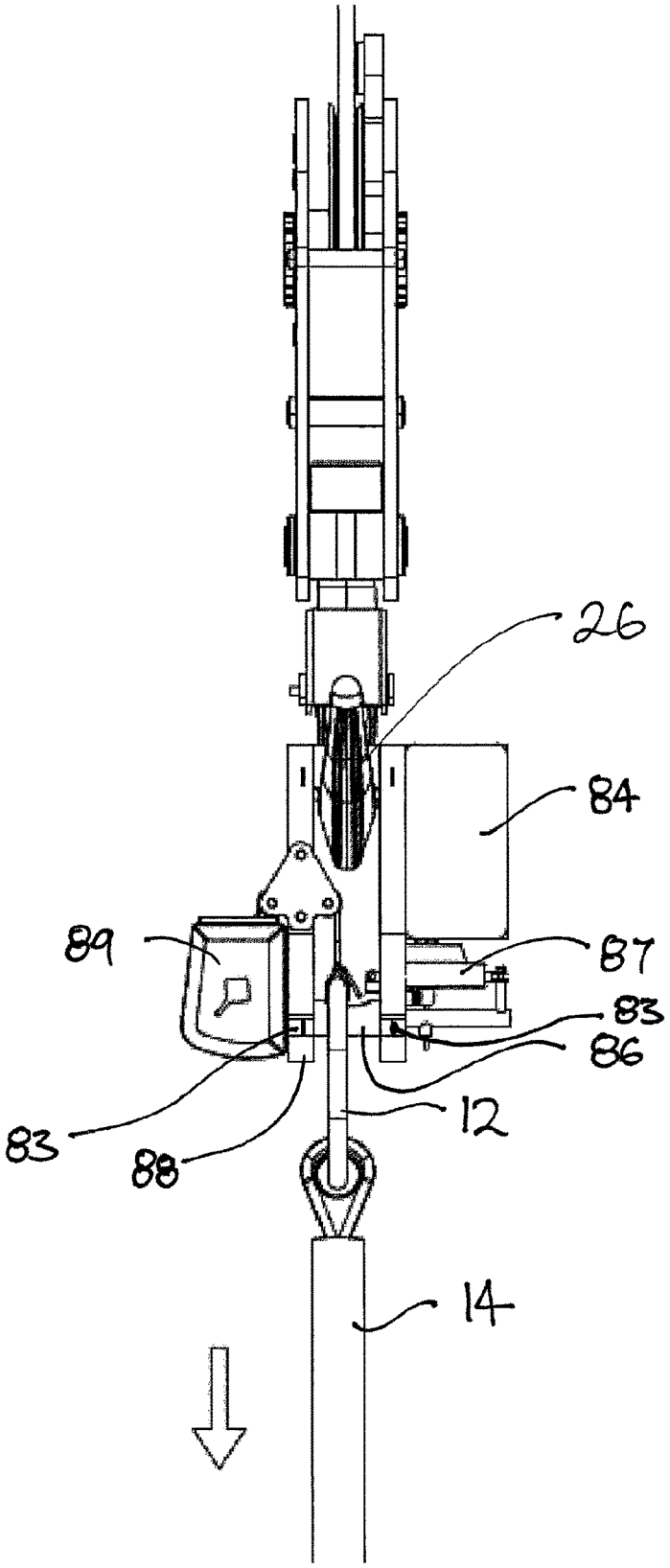
FIG. 18 is a front view of the capture device of FIG. 3 in a position where the link of the connection means of the lifeboat vessel is captured and is lowered onto the locking pin of the capture device for lifting of the lifeboat vessel.
Figure 19A:
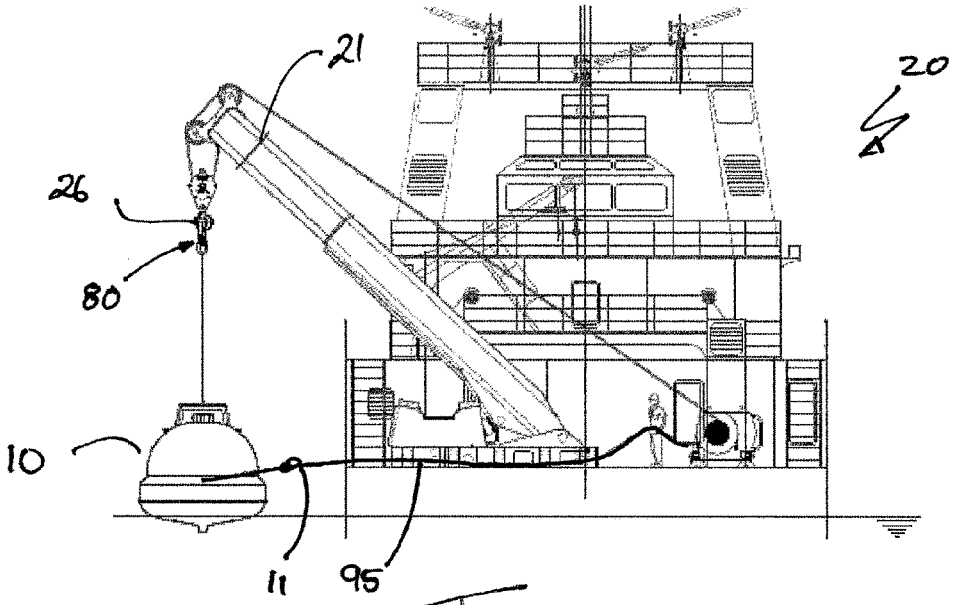
FIGS. 19A and 19B are end and top views respectively of a recovery vessel preparing to retrieve a lifeboat vessel following capture of the connection means of the lifeboat vessel by the capture device as depicted in FIG. 18 in accordance with another step of retrieving a lifeboat vessel in accordance with the present invention.
Figure 19B:
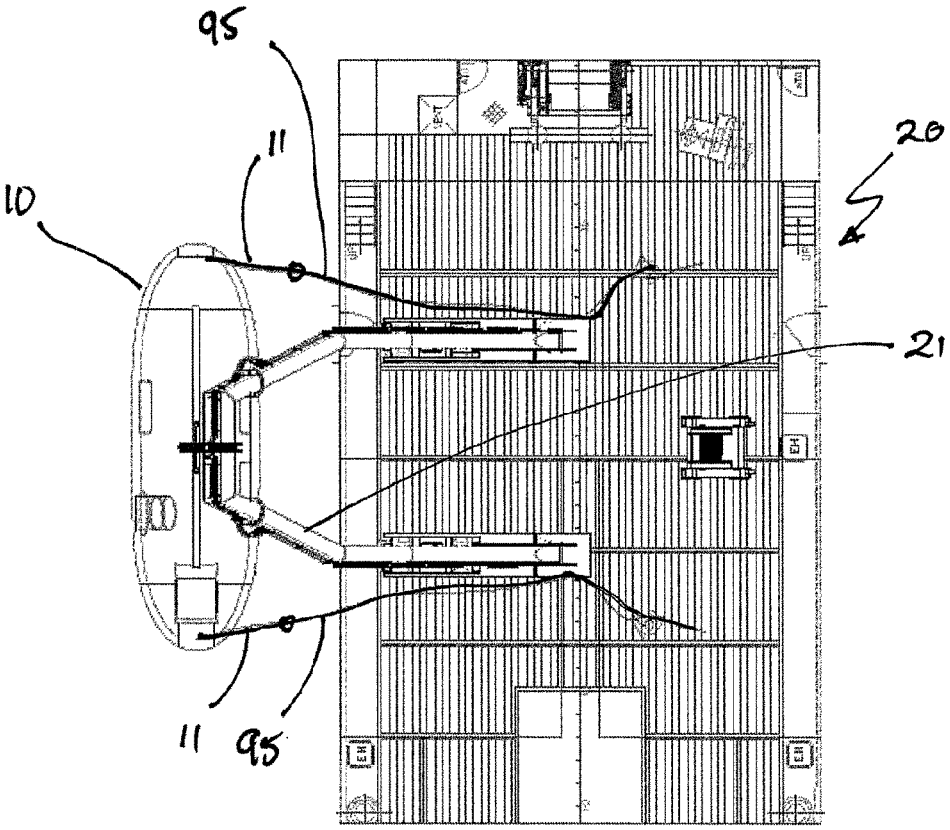

The locking pin 86 is then locked in place and the winch 89 is reactivated to lower the cable 91 such that the link 12 is fully supported by the locking pin 86, as is shown in FIG. 18. When the device 80 is in this position, the vessel 10 is ready to be raised from the water, as shown in FIGS. 19A and 19B. In this position, the crew on the rescue vessel 20 act to maintain tension in the tag lines 95 as the vessel 10 is raised from the water, to minimise swinging of the vessel 10, which could be dangerous.

Figure 20A:
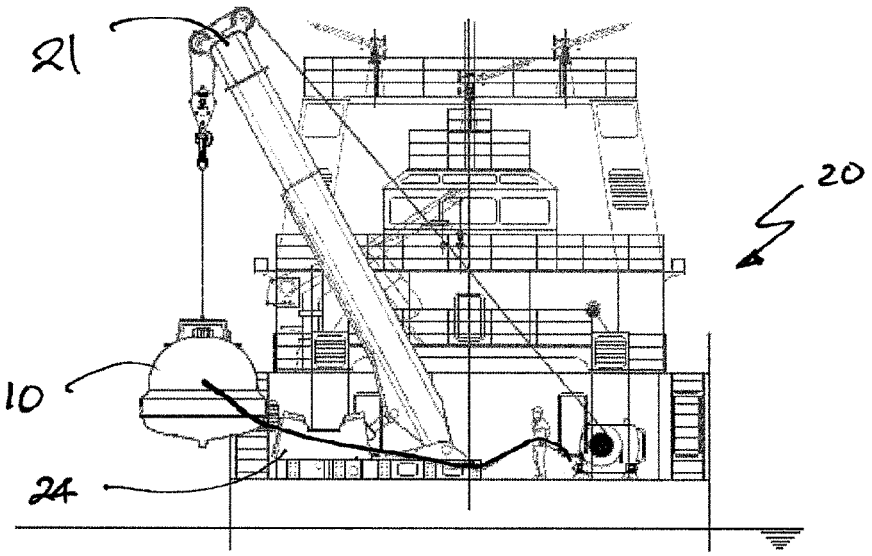
FIGS. 20A and 20B are end and top views respectively of a recovery vessel retrieving a lifeboat vessel in accordance with another step of retrieving a lifeboat vessel in accordance with the present invention.
Figure 20B:
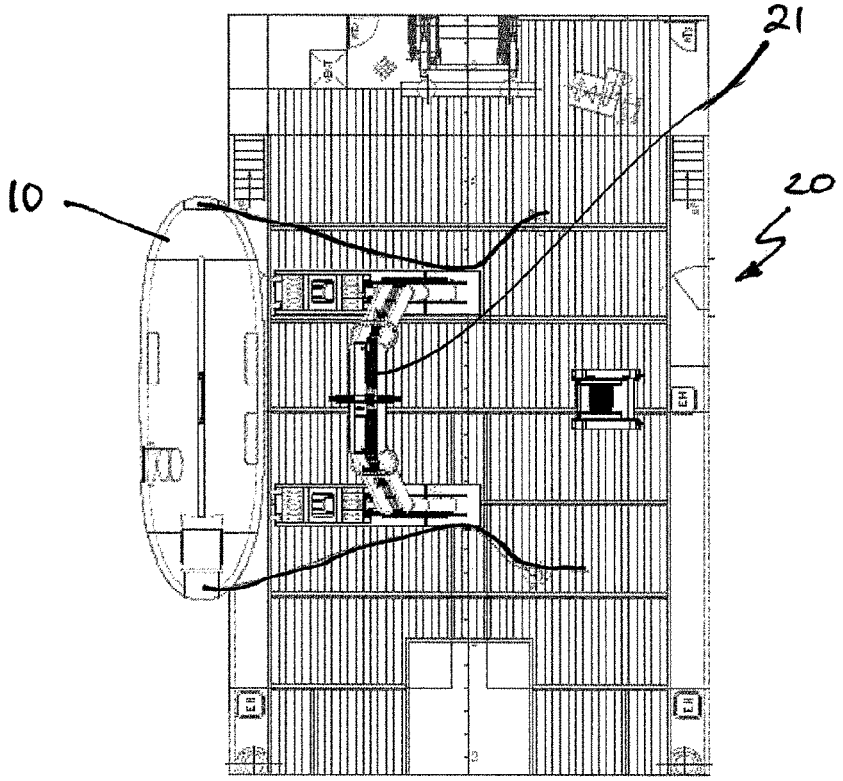
Figure 21A:
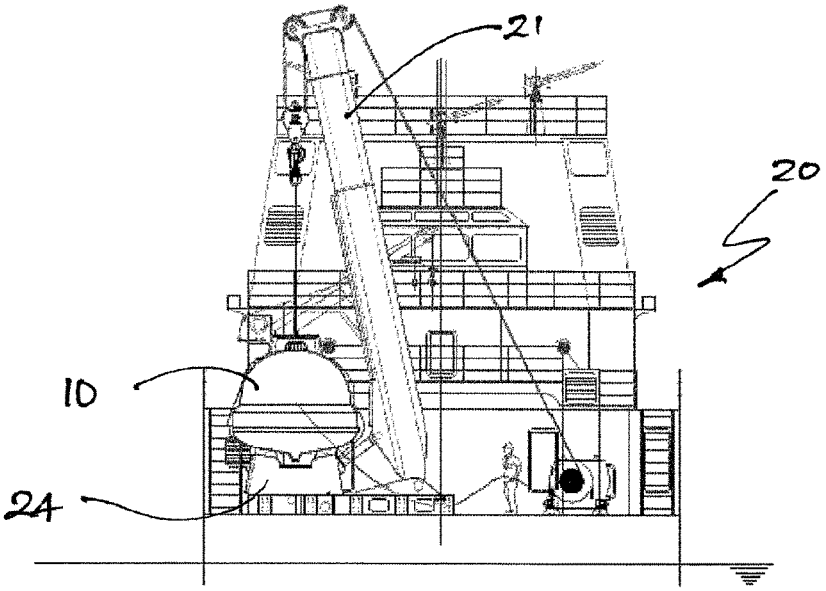
FIGS. 21A and 21B are end and top views respectively of a recovery vessel securing the lifeboat vessel to the cradle to complete retrieval of the lifeboat vessel in accordance with the present invention.
Figure 21B:
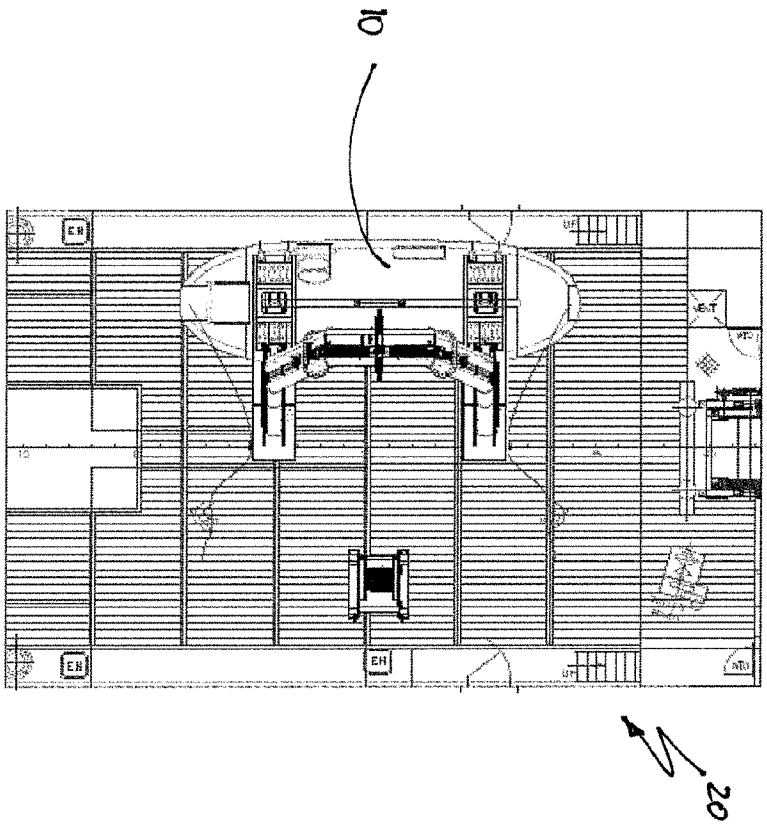

In FIGS. 20A and 20B, when the vessel 10 has been raised from the water by the lifting device 21 such that the vessel 10 is clear of the deck of the recovery vessel 20, the A-Frame of the lifting device is raised into the vertical position thereby positioning the vessel above the cradle 24. In this position, the vessel 10 can be simply lowered onto the cradle 24 and tie down straps can be employed to secure the vessel 10, thereby completing the recovery process, refer FIGS. 21A and 21B.

It will be appreciated that the capture device 80 of the present invention provides an effective means for gathering and capturing the master link of the vessel, even in the presence of rough seas and large swell. Once the coxswain present on the vessel 10 makes the connection between the cable 91 of the capture device 80 and the master link 12 of the vessel 10, the capture device is able to direct the master link 12 into a position where it can be securely captured and retained for lifting. The capture device 80 is specifically provided to merely raise and capture the sling of the vessel 10 and is not directed towards providing any lifting function to remove the vessel 10 from the water. In this manner, it is the ability of the capture device 80 to gather and locate the master link 12 in the presence of considerable movement as may be the case in heavy seas, which provides considerable savings in time associated with retrieving such vessels.

Figure 22:
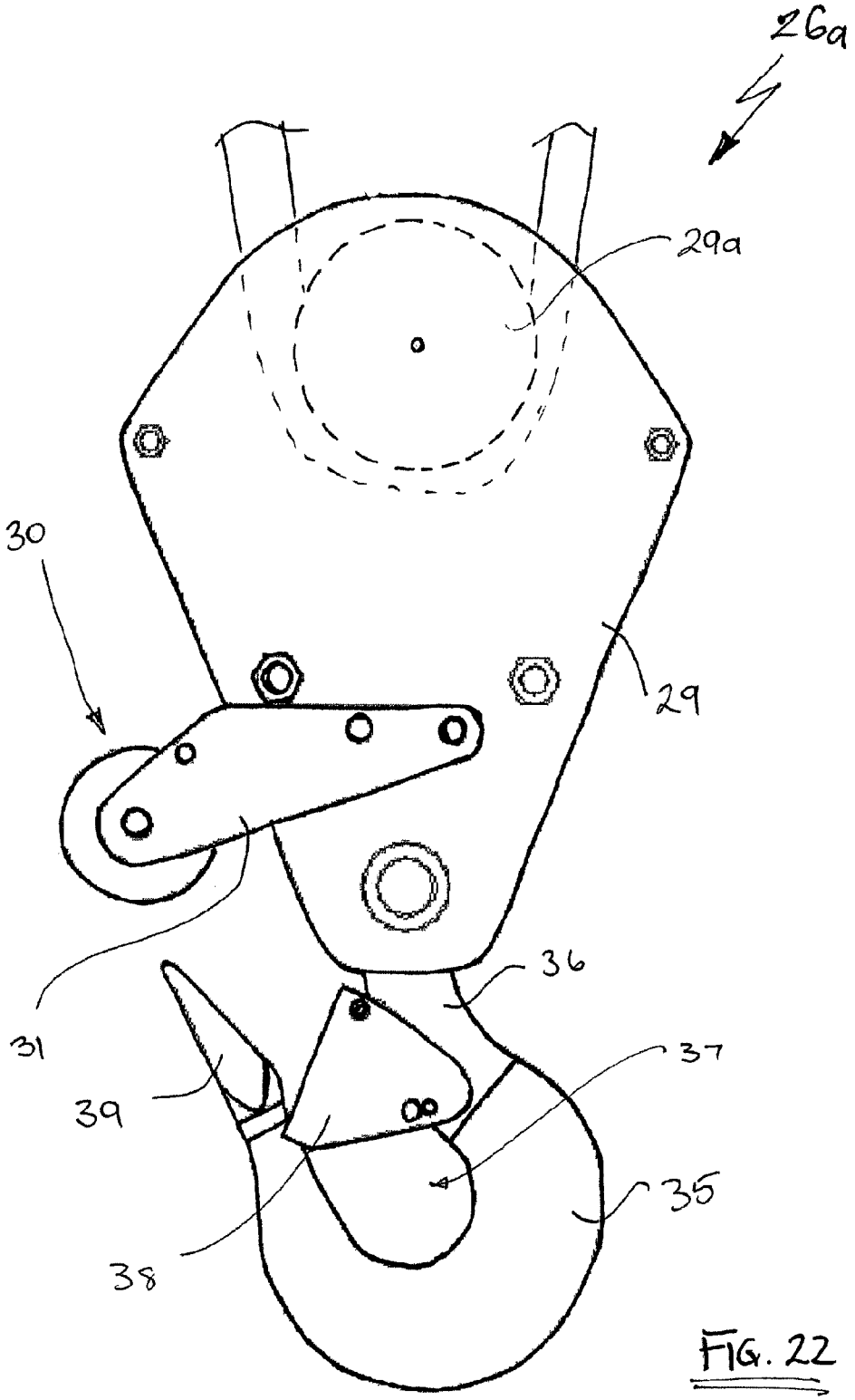
FIG. 22 shows a capture device in accordance with a second embodiment of the present invention.
Figure 23:
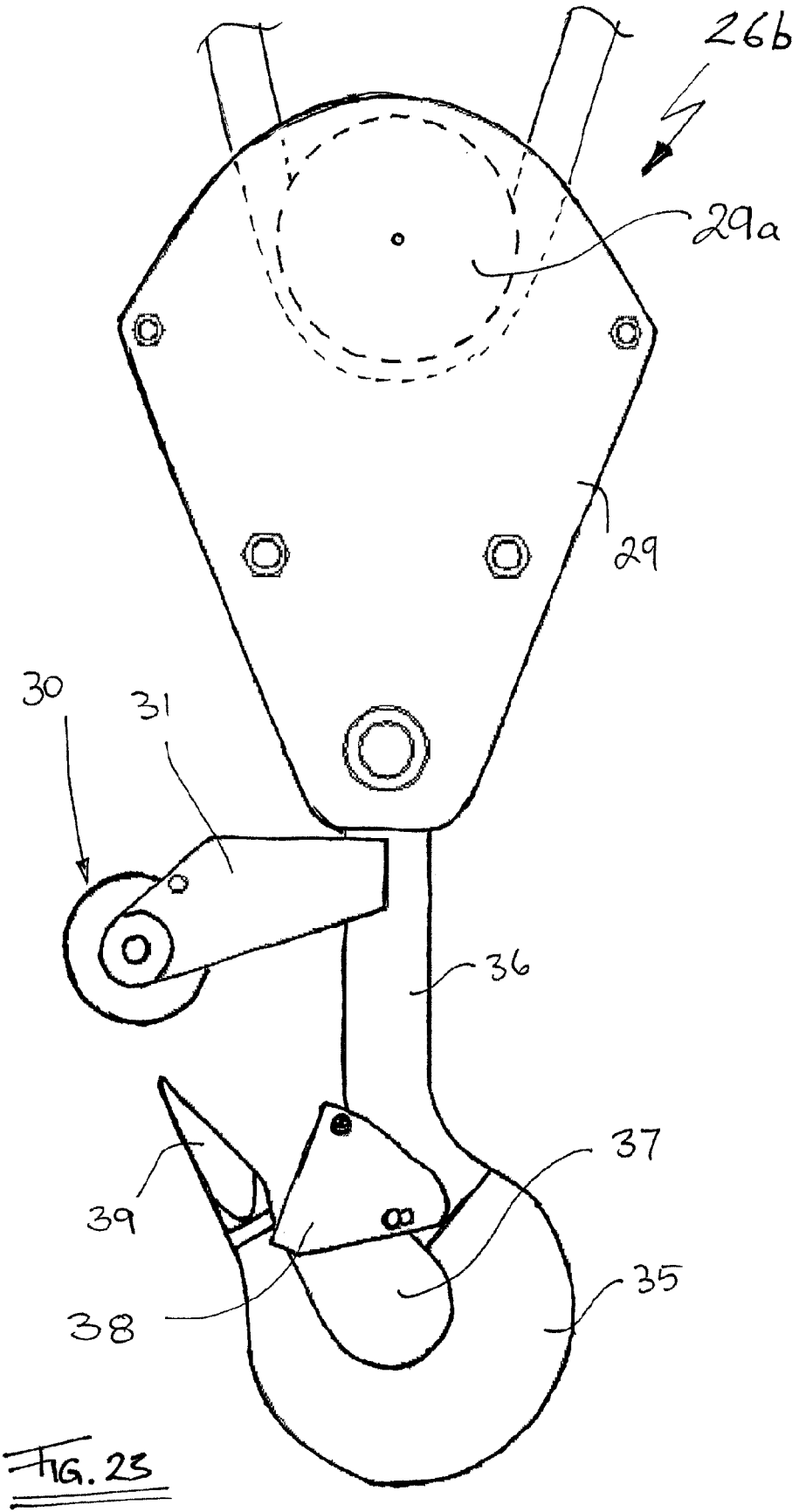
FIG. 23 shows a capture device in accordance with a third embodiment of the present invention.

Referring to FIGS. 22 and 23, an alternative embodiment of a capture device is described. This capture device comprises a hook 26*a*, 26*b* in accordance with a second and third embodiment of the present invention. The hook 26*a*, 26*b* is to be employed with the lifting device 21 to capture and lift the lifeboat 10 from the water in the manner as will be discussed in more detail below. Both hooks 26*a* and 26*b* represent a conventional hook that is commonly used in the marine industry for hoisting cargo and the like.

Referring to FIG. 22, hook 26*a* comprises a main body or block 29 that is mountable to the end of a hoisting cable or chain by way of a centrally mounted sheave member 29*a*. A hooking member 35 extends from a lower region of the block 29 and is shaped in the conventional manner to define a space 37 into which elements are captured for transporting by the hook 26*a*. The hooking member 35 comprises a stem portion 36 that is mounted within the block 29. In the embodiment of the capture device as depicted in FIG. 22, the hooking member is substantially rigidly fixed to the end of the block 29, although there may be a degree of swivel movement possible between the hooking member and the block 29, although this is undesirable for the system to function in the manner as desired. However, in the hook 26*b* depicted in FIG. 23, the stem portion 36 is longer and is mounted to the block 29 in a manner that permits swivel movement of the hooking member 35 and this embodiment is preferred in such an instance.

A spring closing member 38 is mounted within the opening of the space 37 of the hooking member 35. The spring closing member 38 functions in a conventional manner to enable an element to enter the space 37 of the hooking member 35, to be captured therein. The closing member 38 is biased into the closed position, as shown, such that when the element is received in the space 37, the closure member returns to the closed position to prevent inadvertent displacement of the element from the hooking member 35 during movement of the element. Such a closing member 38 is well known in the prior art.

In accordance with the present invention, a sheave 30 is mounted to the block 29 such that it is positioned immediately above the opening of the hooking member 35, as shown. The sheave 30 has a conventional form and has a central groove for holding a belt, rope or cable, in a manner as will be discussed in more detail below. The sheave 30 is mounted to the block 29 so as to be in vertical alignment with the hooking member 35 and comprises a bracket 31 that is able to be connected to the block 29 by way of screws, bolts, rivets or other similar connecting means. The bracket 31 is configured such that the sheave is positioned immediately in front of the opening of the hooking member 35 as shown, such that there is a gap formed between the sheave and the block 29 to enable a cable to pass therebetween during use.

Figure 24:
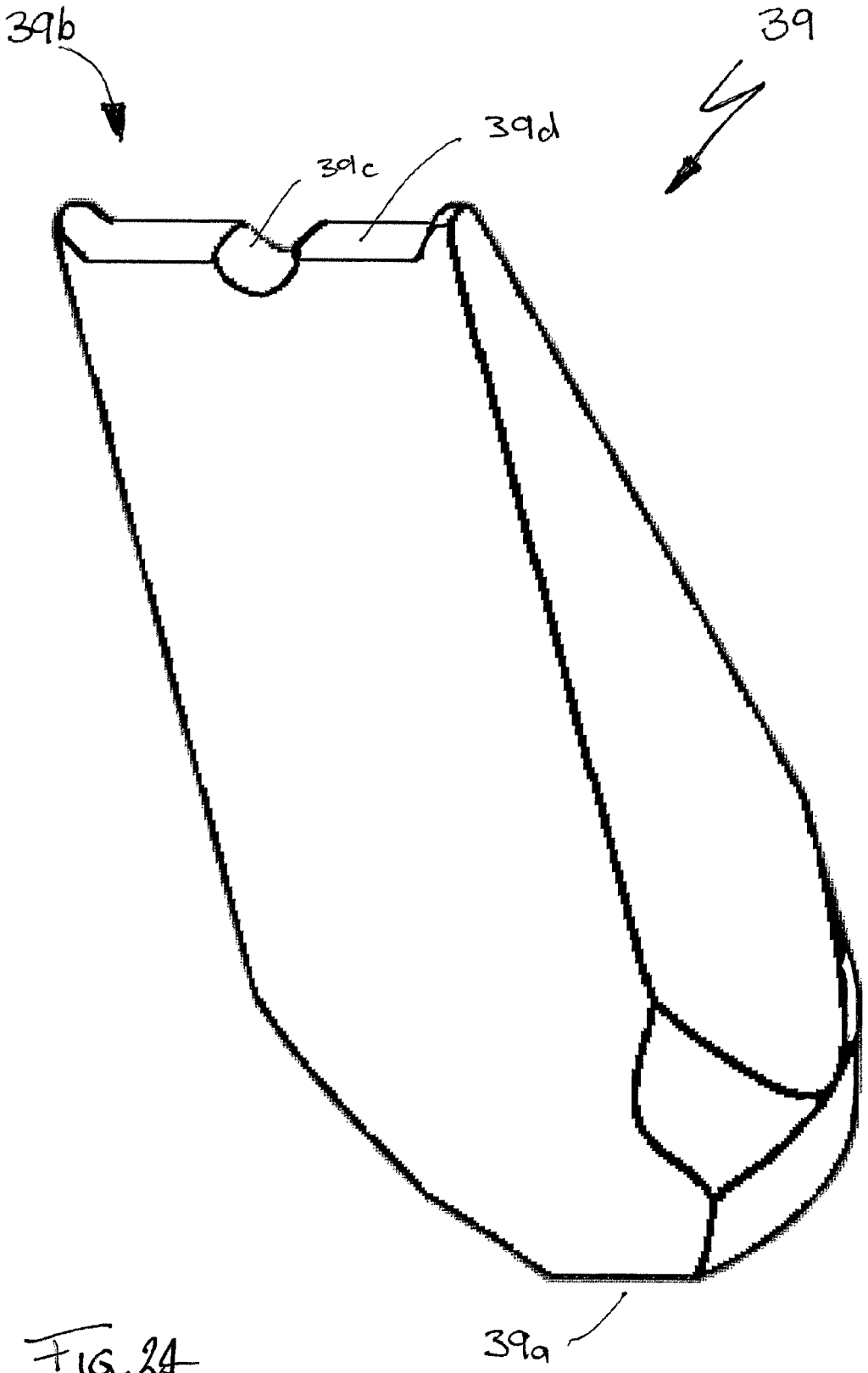
FIG. 24 is a perspective view of a keeper member for use with the embodiments of the capture device shown in FIGS. 22 and 23.

The capture device of the present invention also provides a keeper member 39 that is mounted to the end of the hooking member 35 in the manner as depicted. The keeper member 39 is depicted in isolation in FIG. 24. The keeper member 39 provides an extension of the underside of the hooking member 35. In a preferred embodiment, the keeper member 39 may be made from a rubber material to have a degree of flexibility. In an alternative embodiment, the keeper member 39 may be made from steel or a similar metal material. As will be discussed in more detail below, the keeper member 39 is configured to capture a link member. In this regard, the keeper member has a mounting end 39*a* for mounting to the end of the hooking member 35 and a distal end 39*b* for guiding and aligning the ropes/cables associated with the link member. The distal end 39*b* has a central groove for receiving and guiding a rope or cable and a wider and flat end 39*c* for receiving and positioning a wider ribbon or belt associated with the link, where applicable.

In the arrangement of the capture device as depicted in FIG. 23, the same elements have been depicted using the same numbers as used in relation to the capture device of FIG. 22. However, in this embodiment, the sheave 30 and mounting bracket 31 is mounted to the stern portion 36 of the hooking member 35 in order to retain the same special distance therebetween and to ensure that the swivel movement of the hooking member 35 is also experienced by the sheave 30 in accordance with the present invention.

It will be appreciated by those skilled in the art that the capture devices that employ the hook members 26*a* and 26*b* described above are provided in order to improve the means for capturing and securing a masterlink 12 of the lifeboat 10 for retrieving the lifeboat 10 from sea onto the recovery vessel 20, even in the event of very rough seas. This is achieved through the use of an additional connection arrangement that is able to be separately secured to the link member of the masterlink 12 of the lifeboat, and which is able to be retrieved via the sheave and hook configuration of the present invention for engagement with the lifting device 21 of the vessel 20.

Figure 25:
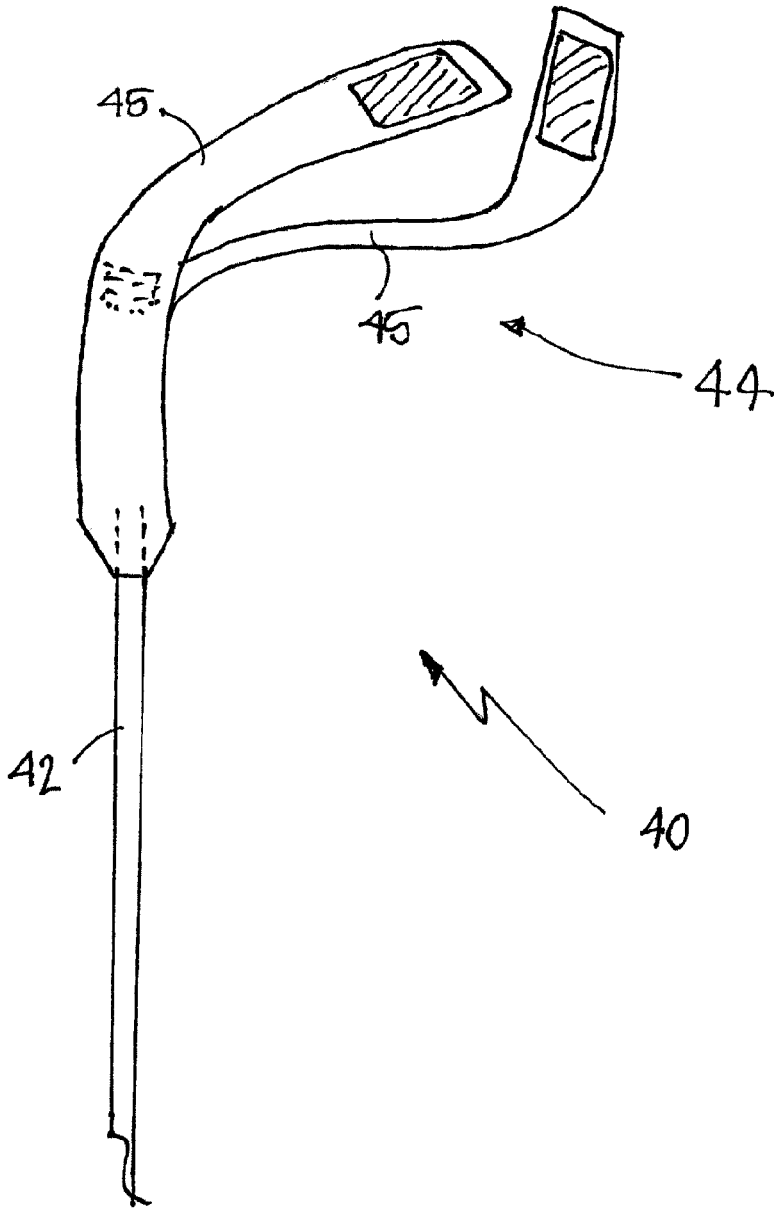
FIG. 25 is a perspective view of a connection arrangement for use with the system and method of the present invention in accordance with a first embodiment.
Figure 26:
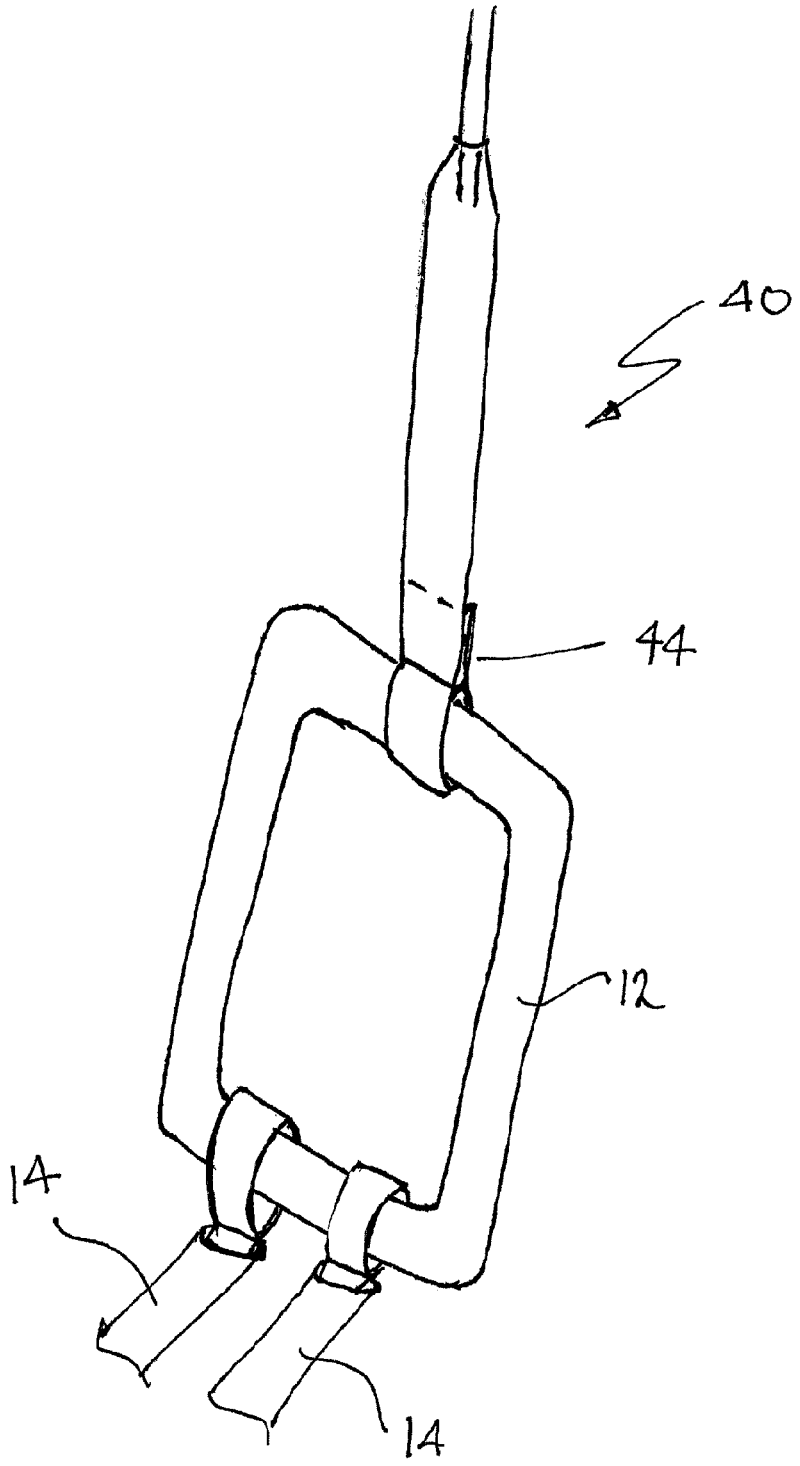
FIG. 26 is a perspective view of the connection arrangement of FIG. 25 in engagement with a masterlink of a lifeboat vessel of FIG. 1.

One embodiment of an additional connection arrangement 40 that may be used with the system of the present invention is depicted in FIG. 25. The connection arrangement 40 comprises a rope or cable 42 having a connector 44 provided at a distal end thereof. The connector 44 may take any variety of forms but is configured to detachably engage with the link portion of the masterlink 12 of the lifeboat 10 in the manner as shown in FIG. 26. In the embodiment depicted by the present figures, the connector 44 comprises a pair of webbing straps 45 that can be securely located about the masterlink 12 and retained in position by hook and loop fasteners or similar securing means. Alternatively the connector 44 may merely be a free end of the rope which is tied about the masterlink 12, or a separate hook that is secured to the masterlink 12. As the connection is to be performed by a person located on the lifeboat 10 in heavy sea conditions, it is envisaged that a simple connector such as a hook and loop fastener straps is preferred. As is shown in FIG. 26, when the connector 44 is secured to the masterlink 12, the masterlink 12 and the sling is able to be retrieved by the recovery vessel 20 in a simple manner, as will be discussed in more detail below. As will be discussed in more detail below, in another embodiment of the present invention where the lifeboat 10 is unmanned, or in the event of recovery of a hyperbaric capsule, the connection arrangement 40 may be pre-connected to the masterlink 12 prior to deployment of the lifeboat or capsule The manner in which the system and method of the present invention is employed to retrieve a lifeboat 10 from the sea is depicted in FIGS. 27-42.

Figure 27:
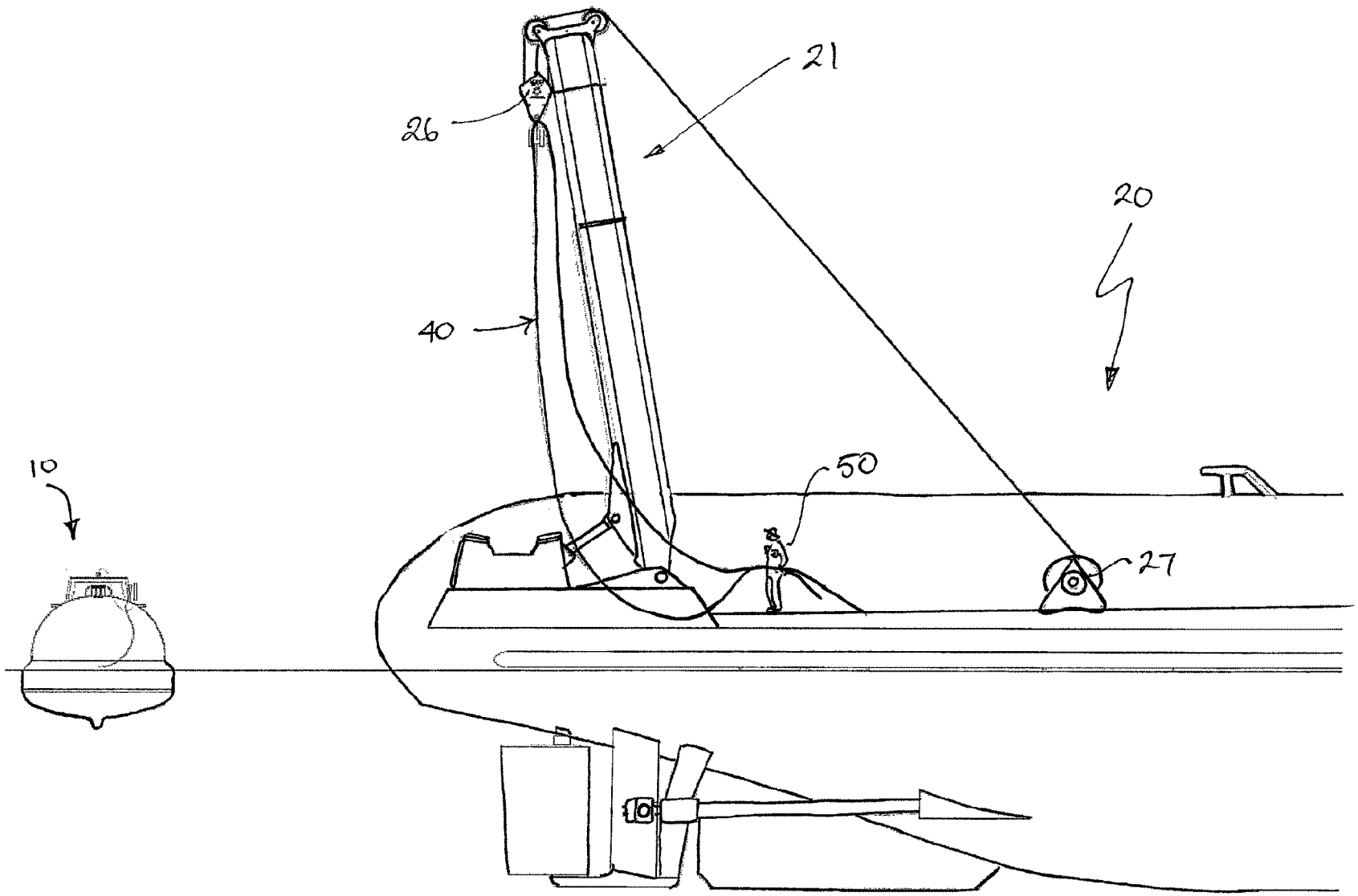
FIG. 27 is a side view of a recovery vessel preparing to retrieve a lifeboat vessel using the capture device of the second or third embodiment of the invention in accordance with a step of the method of the present invention.

FIG. 27 depicts the recovery vessel 20 positioned with respect to the lifeboat 10 such that the stern of the vessel 20 is in close proximity to the lifeboat 10 to enable use of the lifting device 21 to retrieve the lifeboat 10. In this position, the connection arrangement 40 is threaded through the sheave 30 of the hook 26 and with the crew member 50 of the vessel 20 in possession of the end of the connection arrangement 40 where the connector 44 is located.

Figure 28:
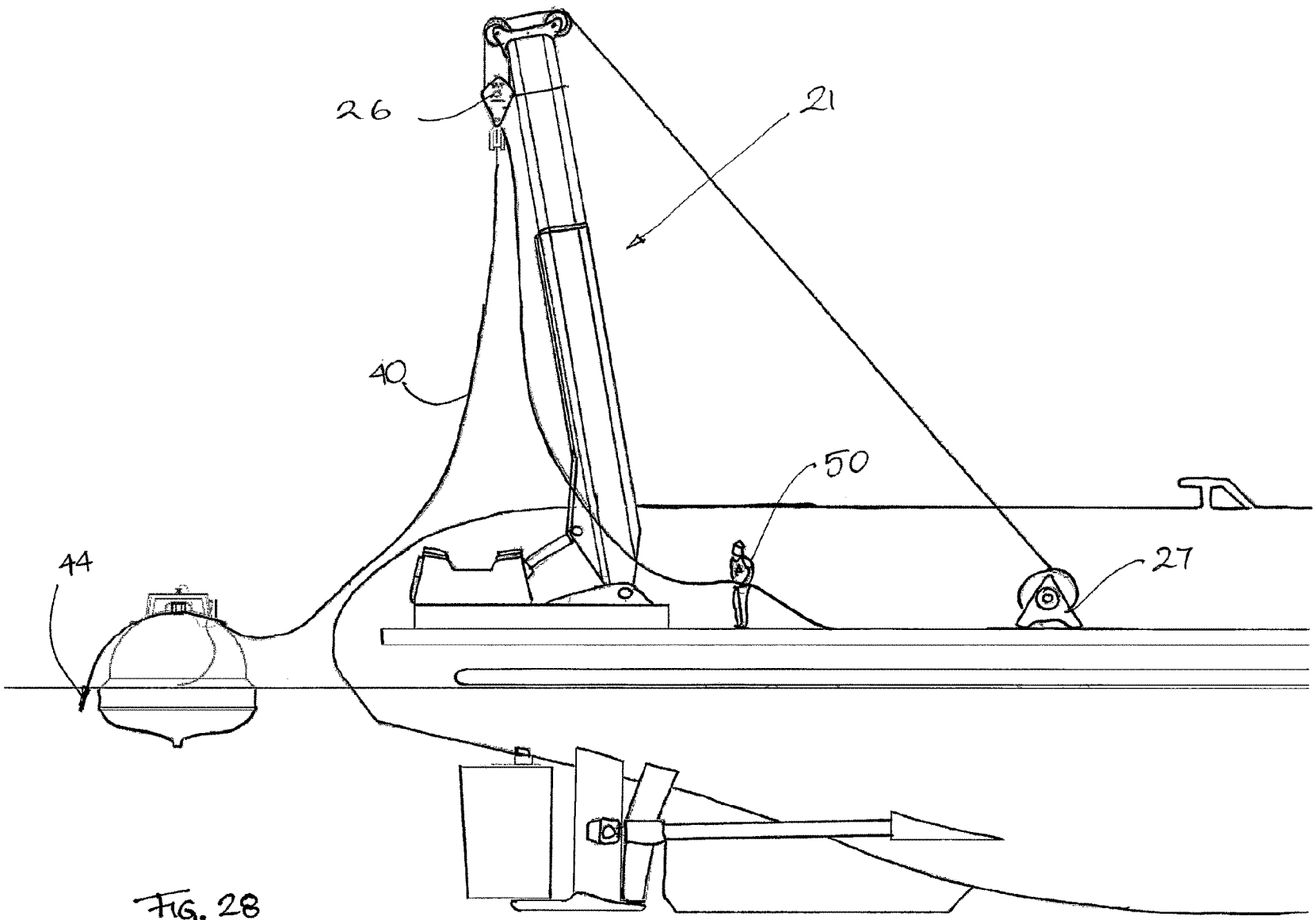
FIG. 28 is a side view of a recovery vessel preparing to retrieve a lifeboat vessel using the capture device of the second or third embodiment of the invention in accordance with another step of the method of the present invention.

As is shown in FIG. 28, to initiate retrieval of the lifeboat 10, the crew member 50 throws, or otherwise passes, the end of the connection arrangement 40 having the connector 44 located thereon over the lifeboat 10, whilst retaining the other end of the connection arrangement 40 in position. In this position the connection arrangement extends from the vessel 20 through the sheave 30 of the hook 26 to the lifeboat 10.

Figure 29:
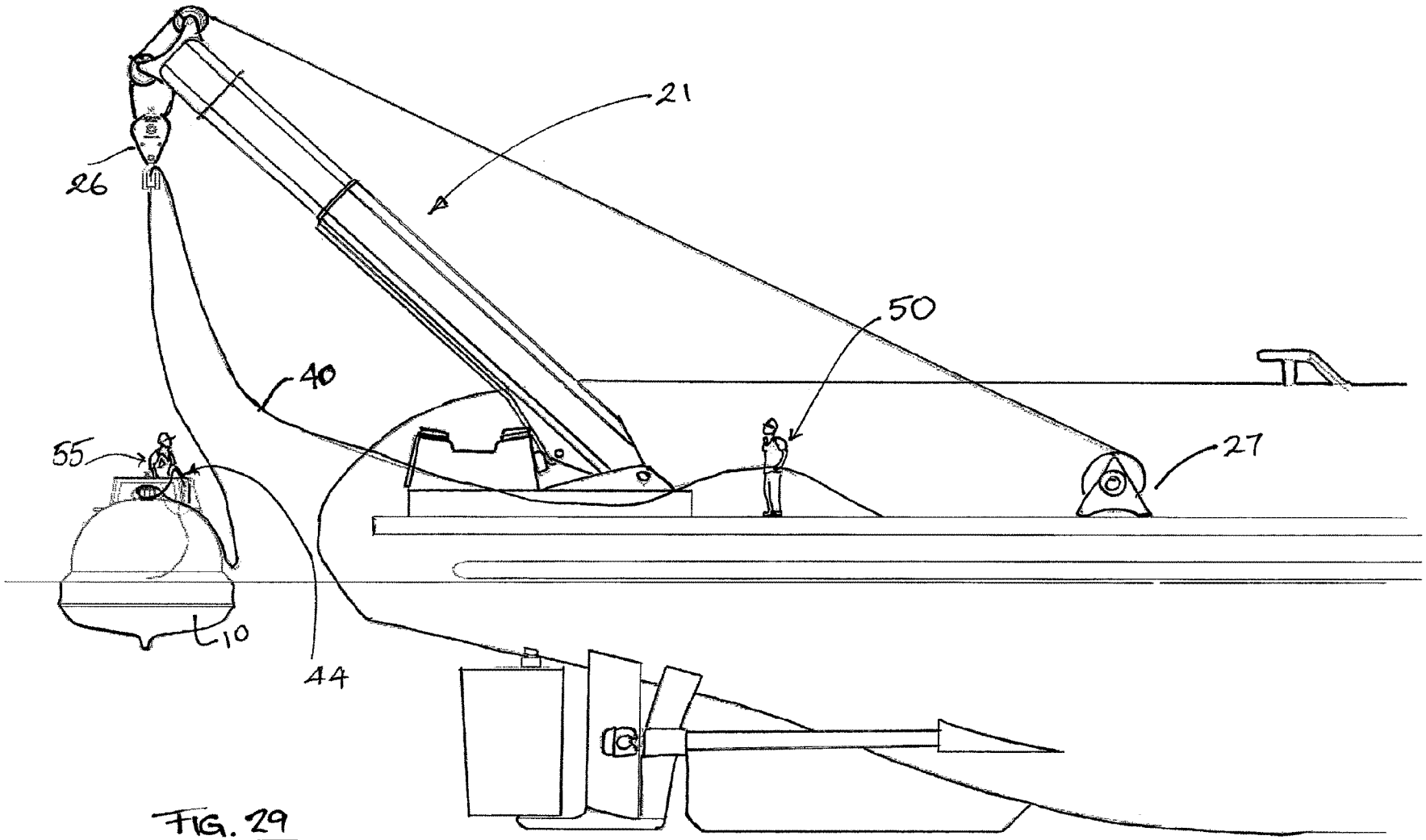
FIG. 29 is a side view of a recovery vessel preparing to retrieve a lifeboat vessel using the capture device of the second or third embodiment of the invention in accordance with another step of the method of the present invention.

In FIG. 29, the coxswain 55 of the lifeboat 10 retrieves the connector 44 at the end of the connection arrangement 40 and secures the connector 44 about the master link 12 in the manner depicted in FIG. 26. The connector 44 is then securely connected to the lifting sling 14 of the lifeboat 10, via the masterlink 12. Once this has been achieved, the A-Frame structure of the vessel is lowered such that the hook 26 is positioned above the lifeboat 10 as shown.

Figure 30:
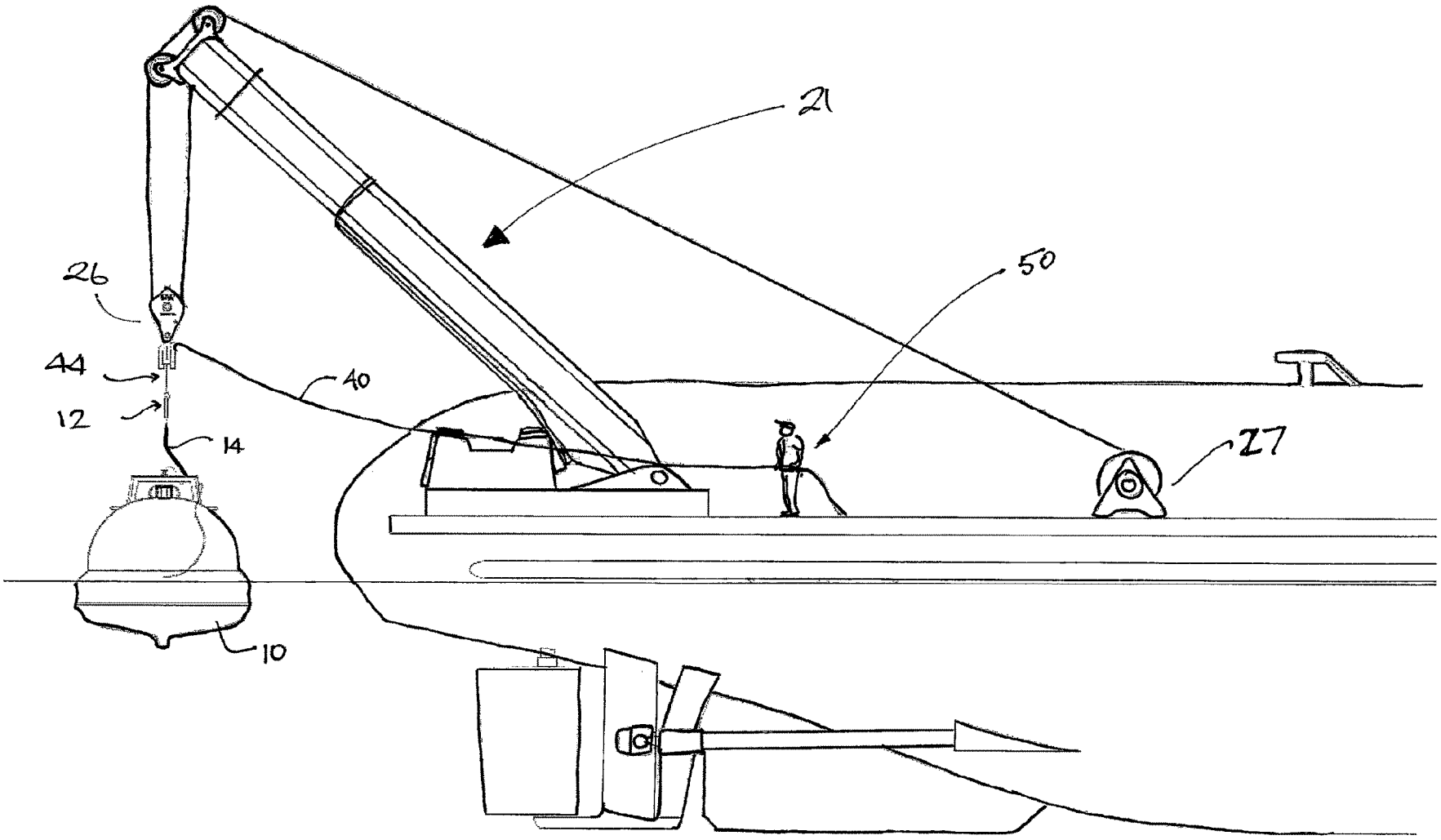
FIG. 30 is a side view of a recovery vessel preparing to retrieve a lifeboat vessel using the capture device of the second or third embodiment of the invention in accordance with another step of the method of the present invention.

As is shown in FIG. 30, with the hook 26 positioned above the lifeboat, the hook 26 is then lowered by use of the winch 27 such that the hook 26 is immediately above the lifeboat 10 but in a position that avoids contact with the lifeboat 10 or coxswain 55. At this stage the coxswain is no longer required to facilitate connection with the hook 26 and may retreat within the confines of the lifeboat 10. The crew member 50 of the vessel can then pull on the other end of the connection arrangement 40, or activate a winch or the like to perform the pulling function.

Figure 31:
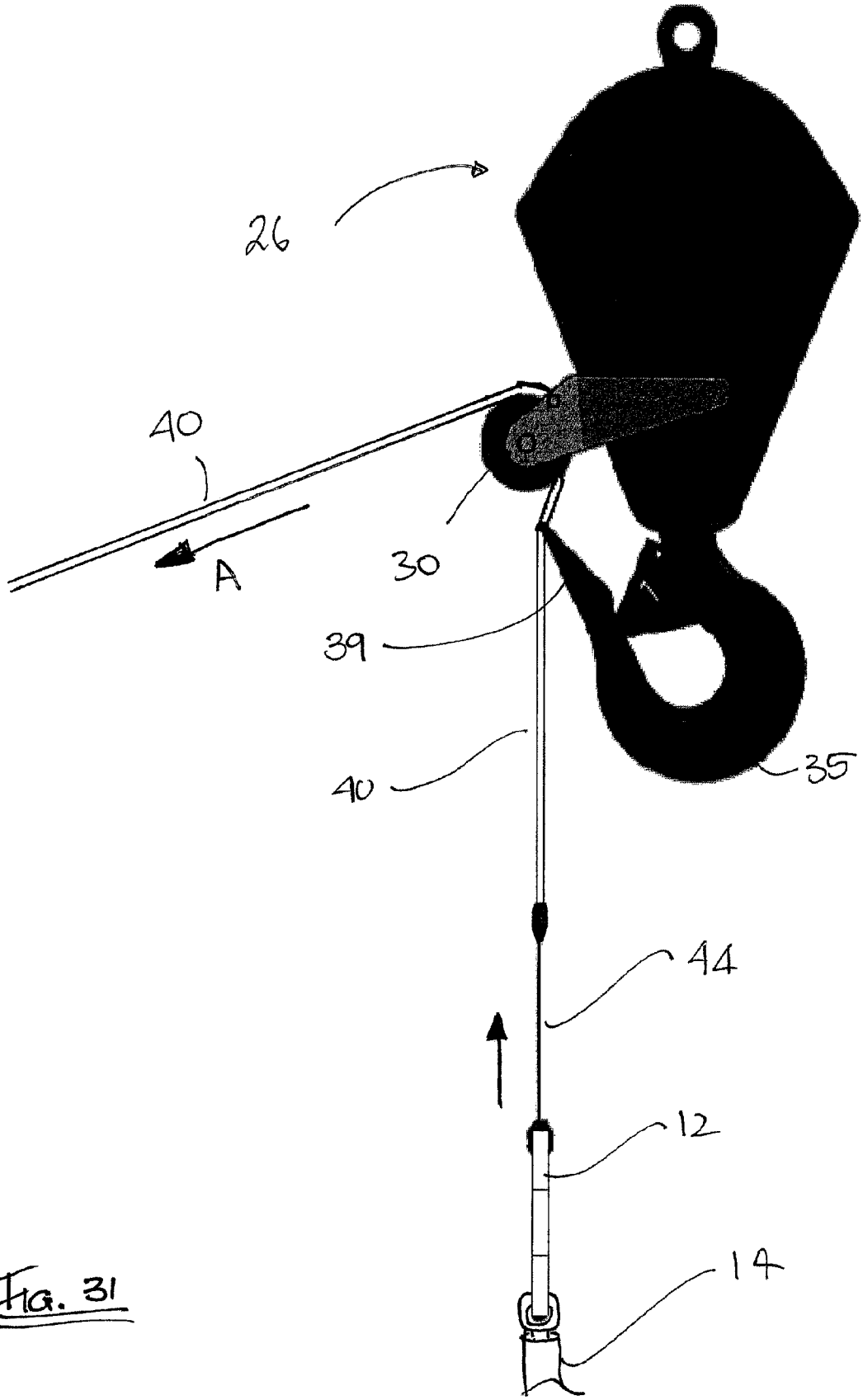
FIGS. 31-35 are side views of the capture device in accordance with the embodiment as depicted in FIG. 22 in use to capture a connection link of the lifeboat vessel.

Referring to FIG. 31, this pulling action in the direction of arrow 'A' causes the masterlink 12 and sling 14 to move towards the hook 26 as the rope portion of the connection arrangement tracks within the sheave 30. As is depicted in FIG. 31, the keeper 39 of the hooking member 35 is in engagement with the rope of the connection arrangement through the groove 39*c* provided in the distal end thereof. This functions to correctly position the masterlink 12 as the connection arrangement 40 is being pulled.

Figure 32:
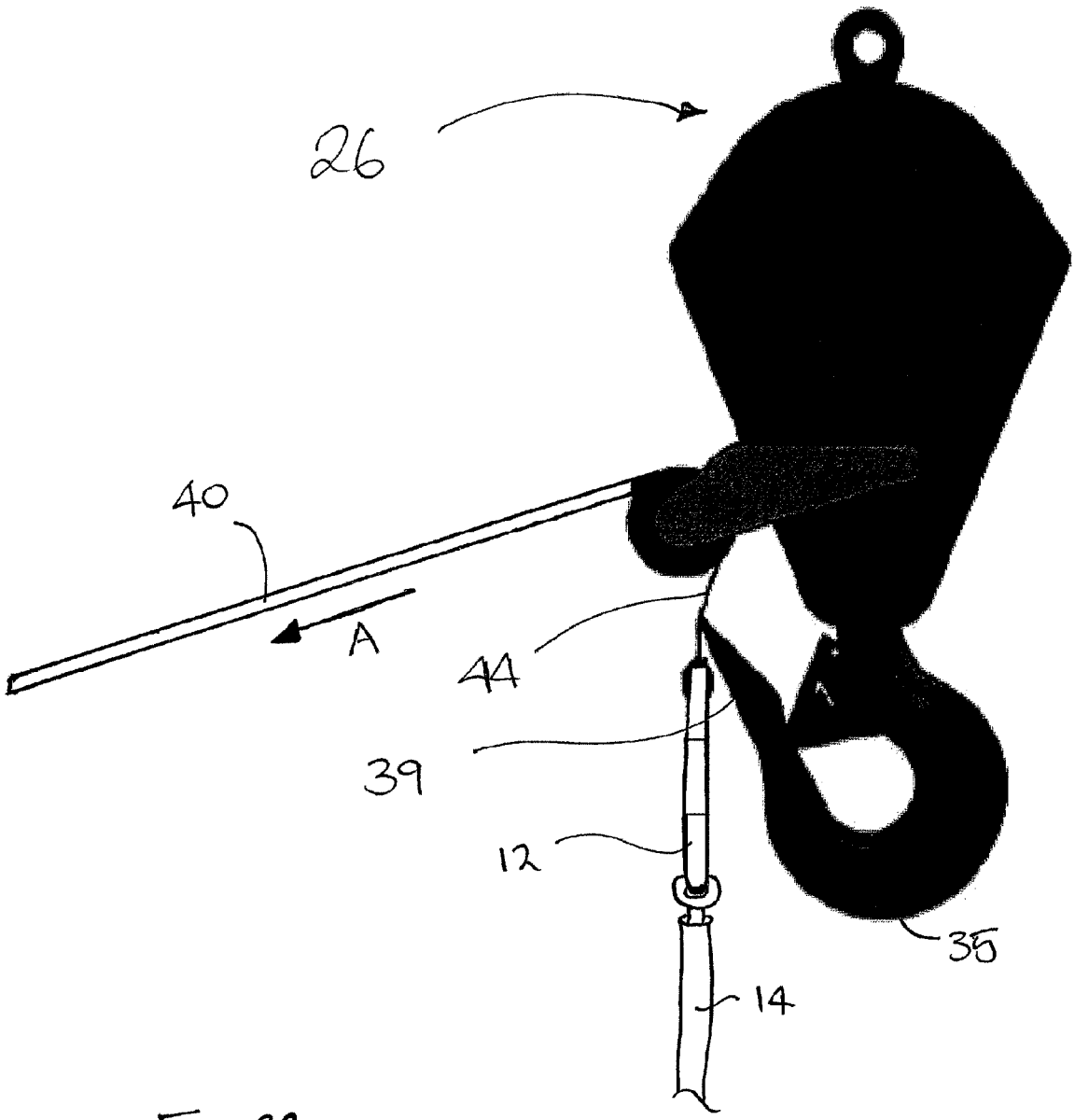
Figure 33:
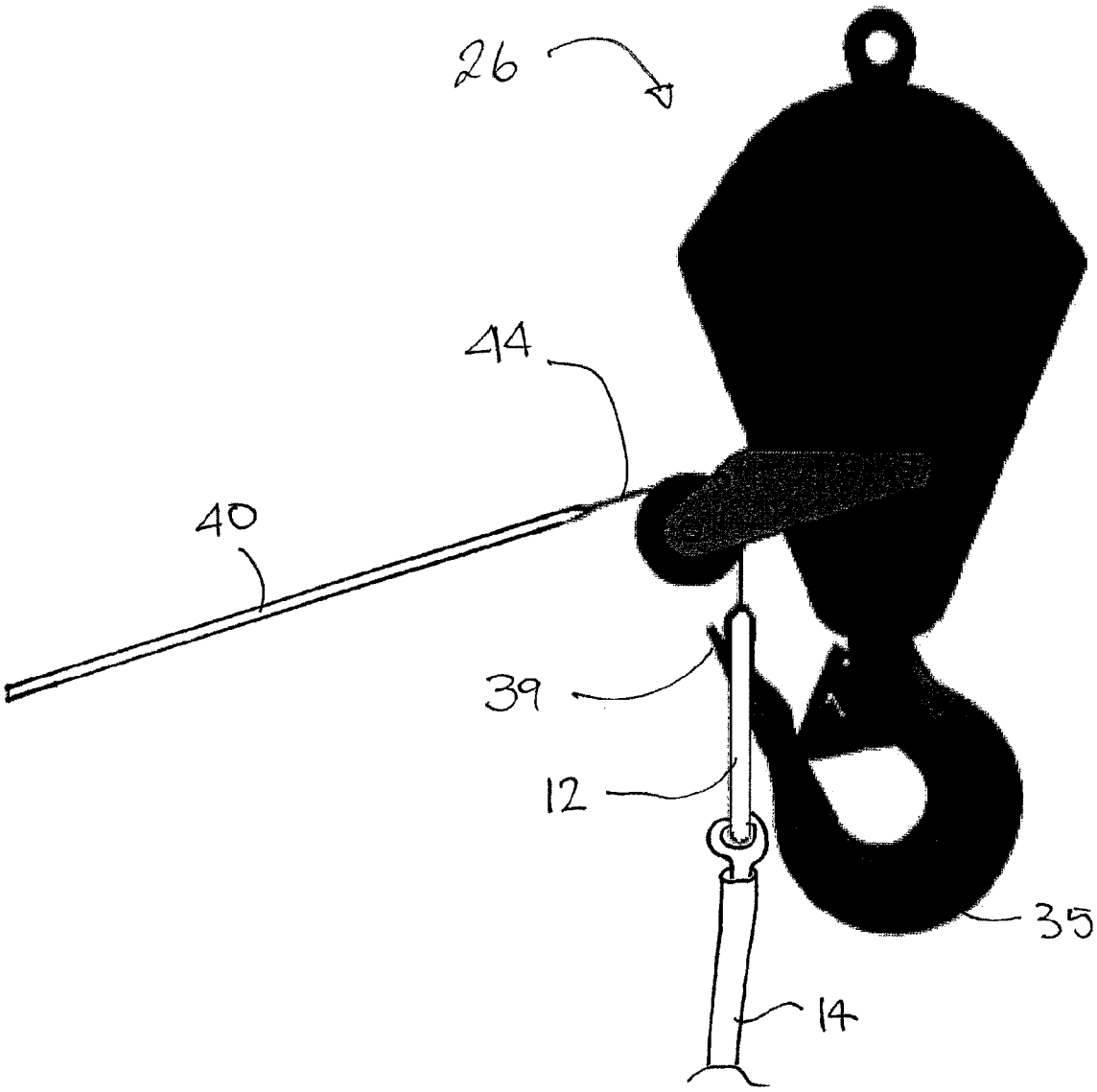
Figure 34:
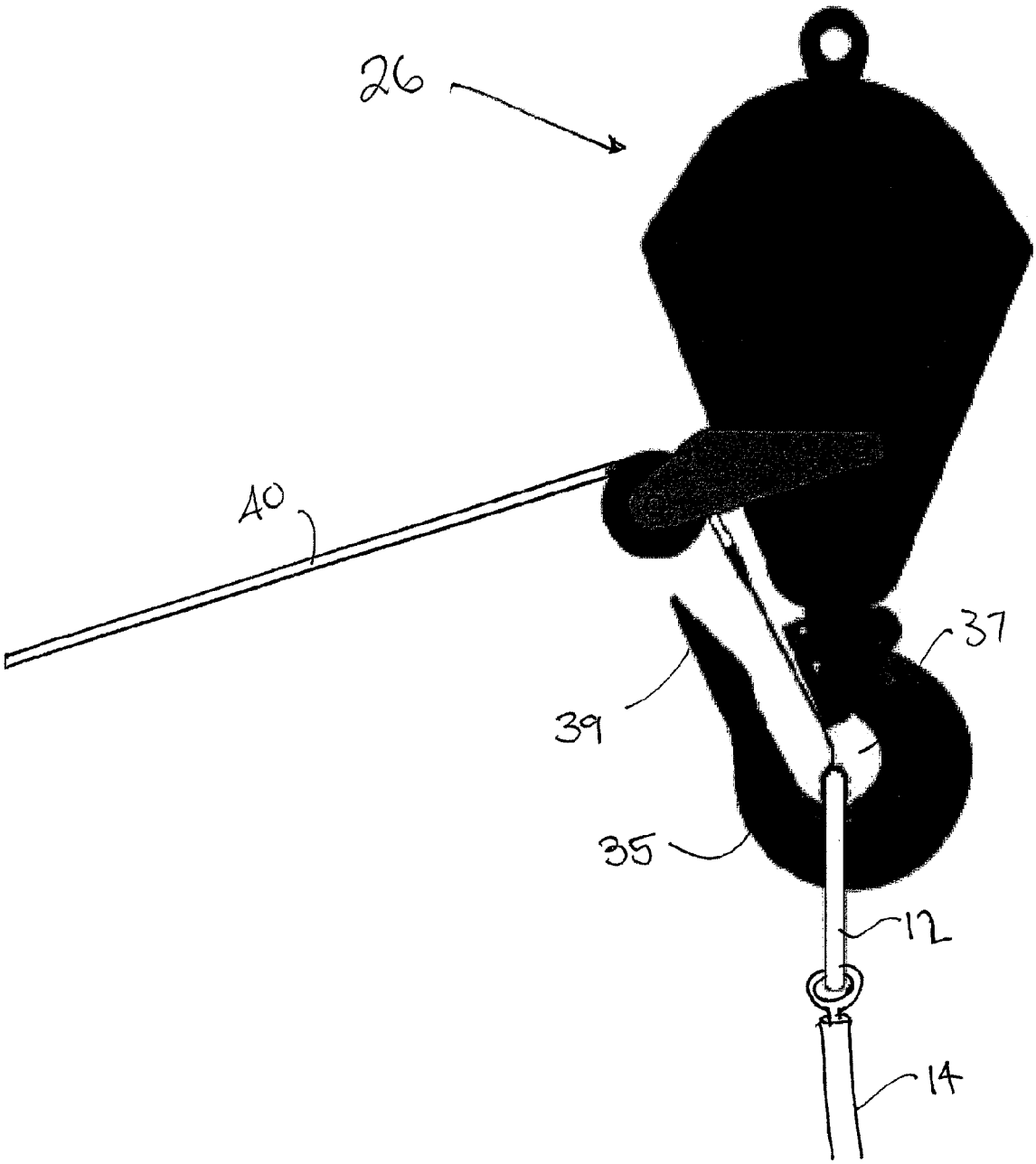
Figure 35:
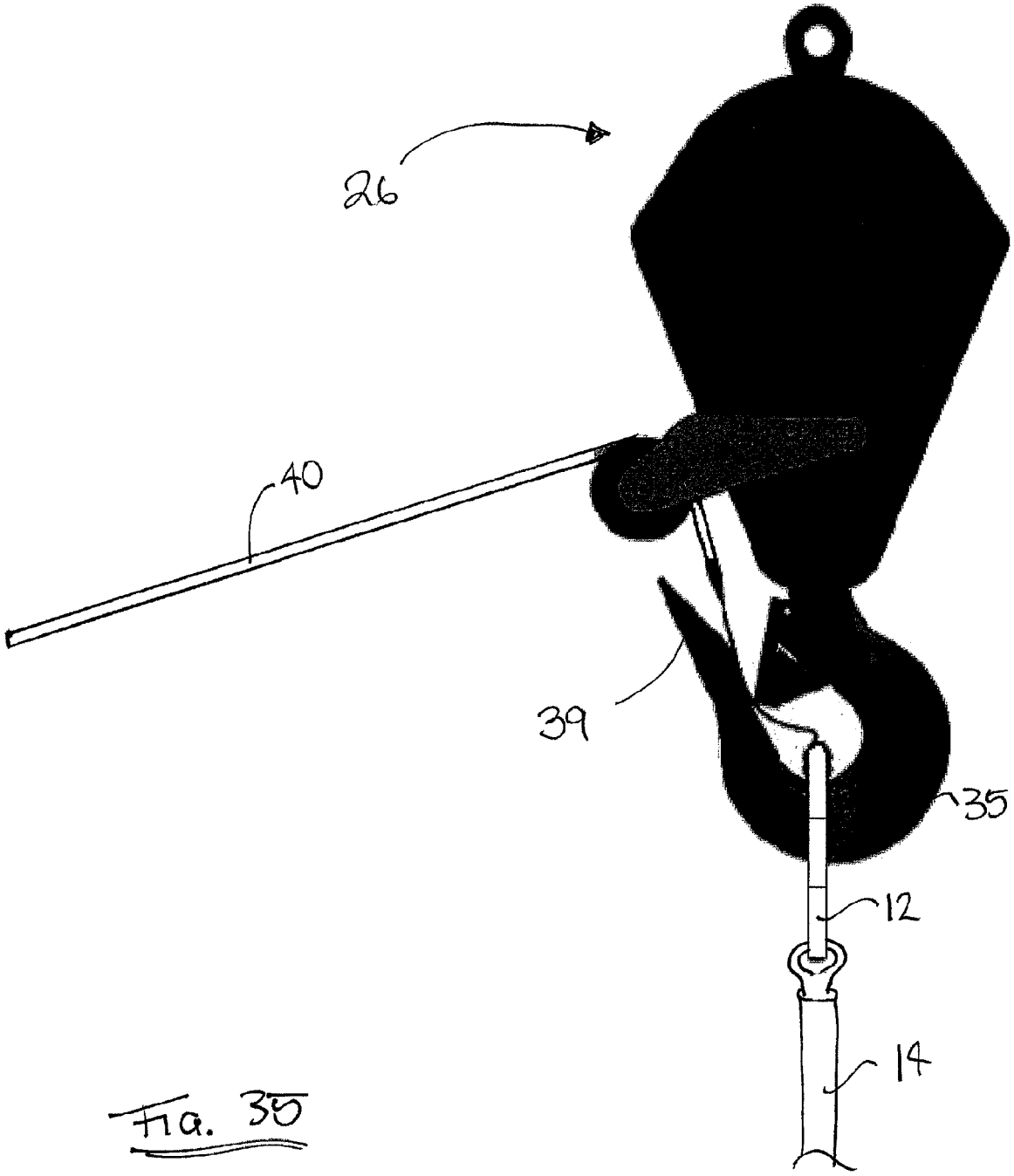
Figure 36:
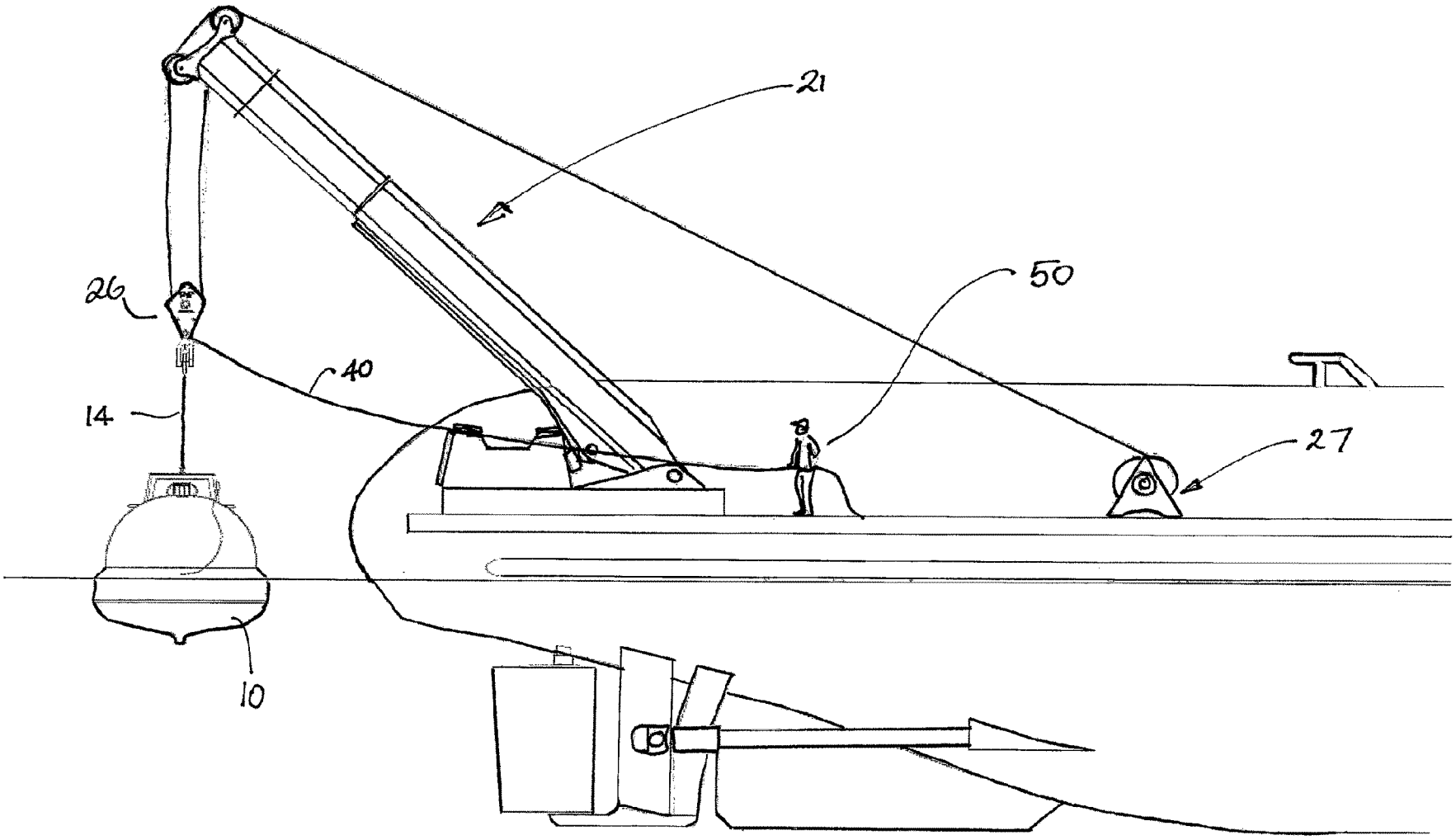
FIG. 36 is a side view of a recovery vessel preparing to retrieve a lifeboat vessel following capture of the connection link of the lifeboat vessel in accordance with another step of the method of the present invention.

Through continuing the pulling action of the connection arrangement 40 by the crew member 50, as is shown in FIG. 32, the thicker webbing portion of the connector comes into contact with the keeper 39. As the distal end of the keeper 39 has a wider flat end 39*c*, the connector 44 is also centered upon the keeper 39 as shown. Referring to FIG. 33, due to the guiding nature of the keeper 39, as the connection arrangement 40 is further pulled in by the crew member 50; the masterlink 12 is brought over the distal end of the keeper 39, such that the distal end of the keeper 39 penetrates through the masterlink 12. At this point, the crew member 50 can stop pulling the connection arrangement 40 to enable the masterlink and sling 14 to fall, under the weight of the masterlink 12 and sling 14, to be received within the space 37 of the hooking member 35 as shown in FIG. 34. As the masterlink 12 falls into position, closing member 38 opens against the spring bias and once the masterlink 12 is received in the space 37, the closing member 38 returns to its biased closed position, thereby capturing the masterlink 12 and lifting sling 14 in the manner as depicted in FIG. 35. This arrangement is depicted in FIG. 36 at which time the crew member 50 can stop pulling the connection arrangement 40 and the lifeboat is ready for lifting by the lifting device 21 and hoist 27 of the vessel 20.

Figure 37:
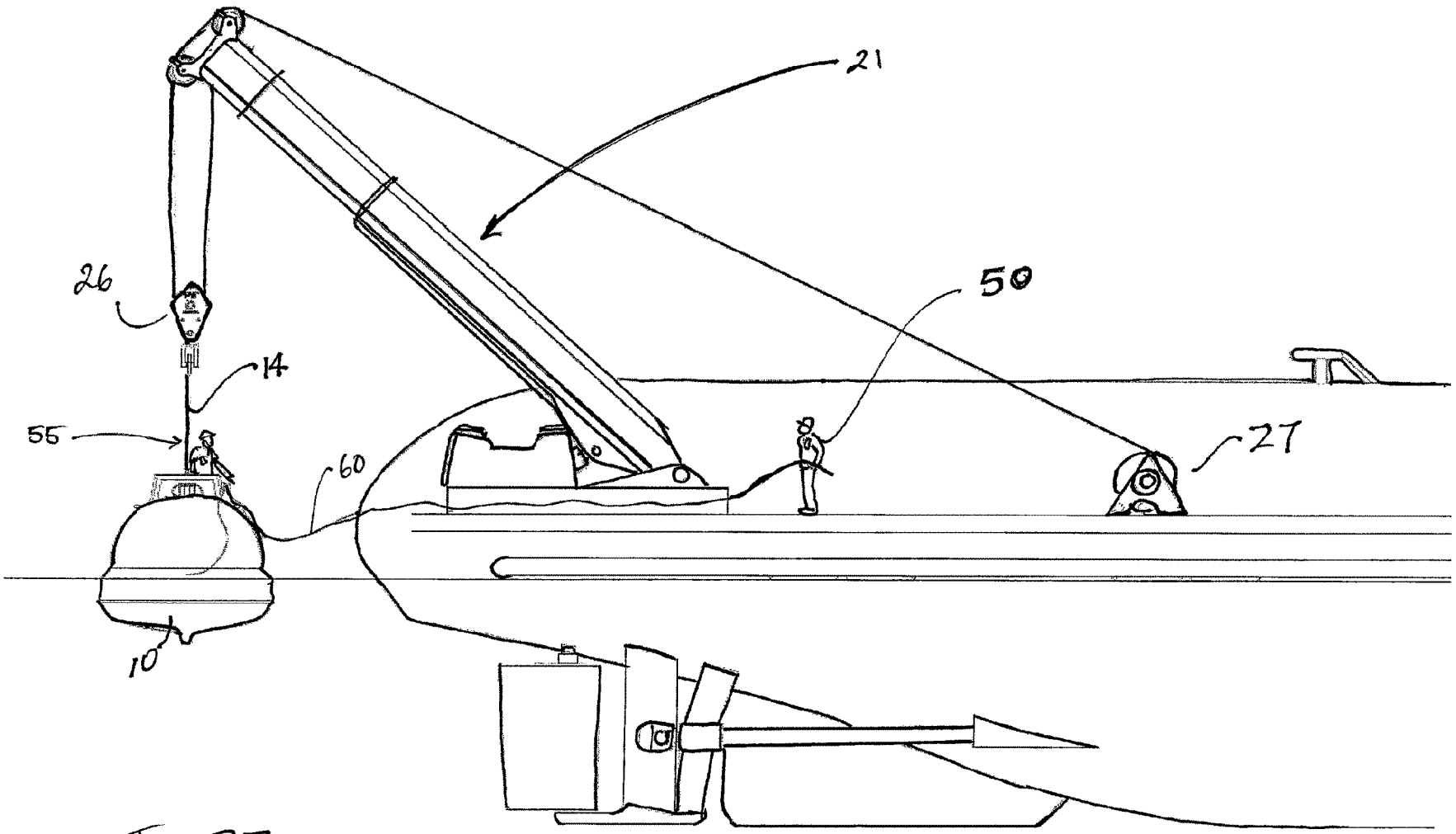
FIG. 37 is a side view of a recovery vessel preparing to retrieve a lifeboat vessel following capture of the connection link of the lifeboat vessel in accordance with another step of the method of the present invention.
Figure 38:
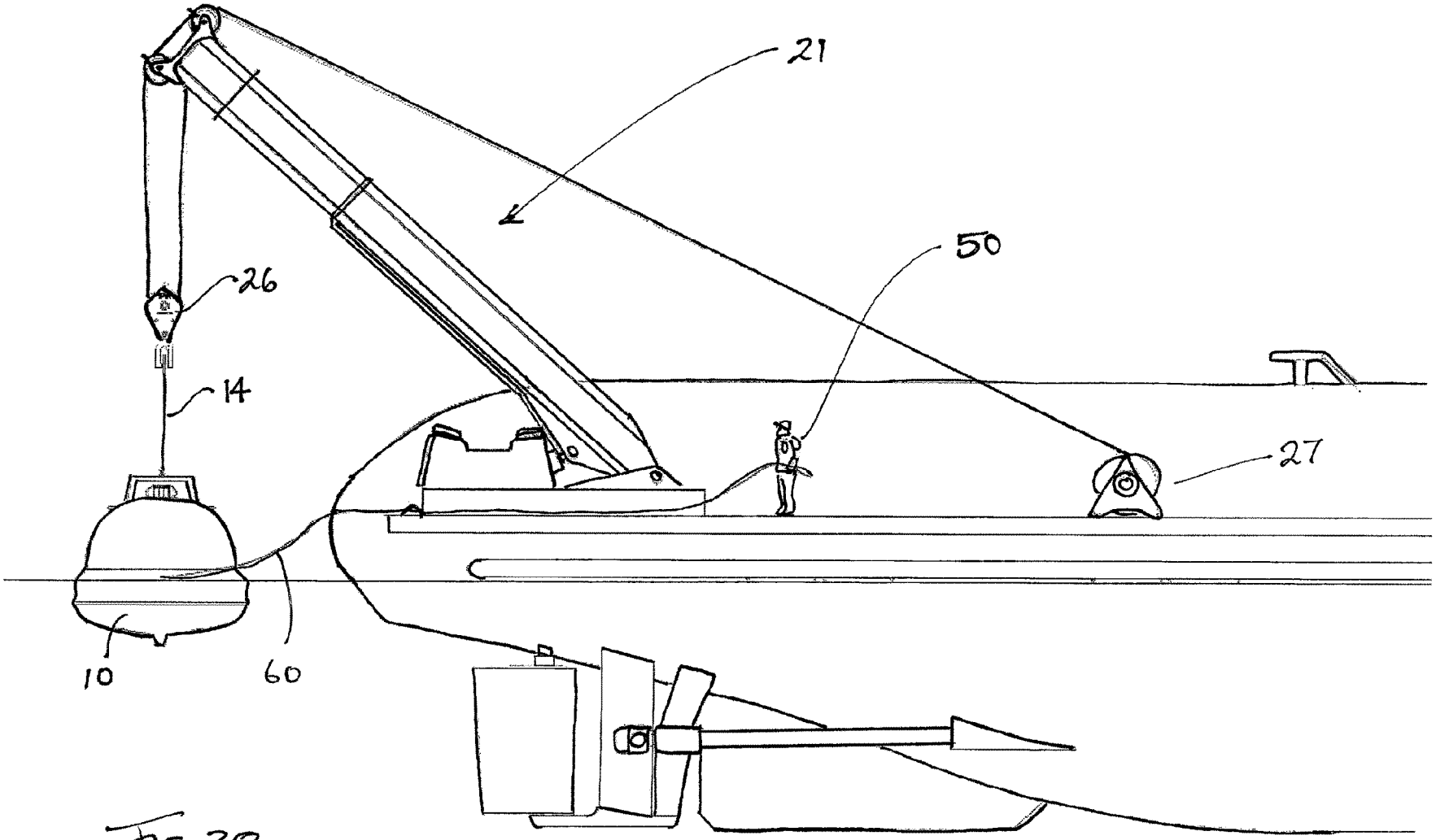
FIG. 38 is a side view of a recovery vessel preparing to retrieve a lifeboat vessel following capture of the connection link of the lifeboat vessel in accordance with another step of the method of the present invention.

To provide stability to the lifeboat for lifting, the coxswain 55 of the lifeboat 10 may then throw additional tag lines 60 connected to the lifeboat 10 across to the crew member 50 present on the vessel 20, as shown in FIG. 37. The crew member 50 or additional crew of the vessel are then able to use the ends of the tag lines 60 to control swing of the lifeboat 10 during retrieval, as shown in FIG. 38.

Figure 39:
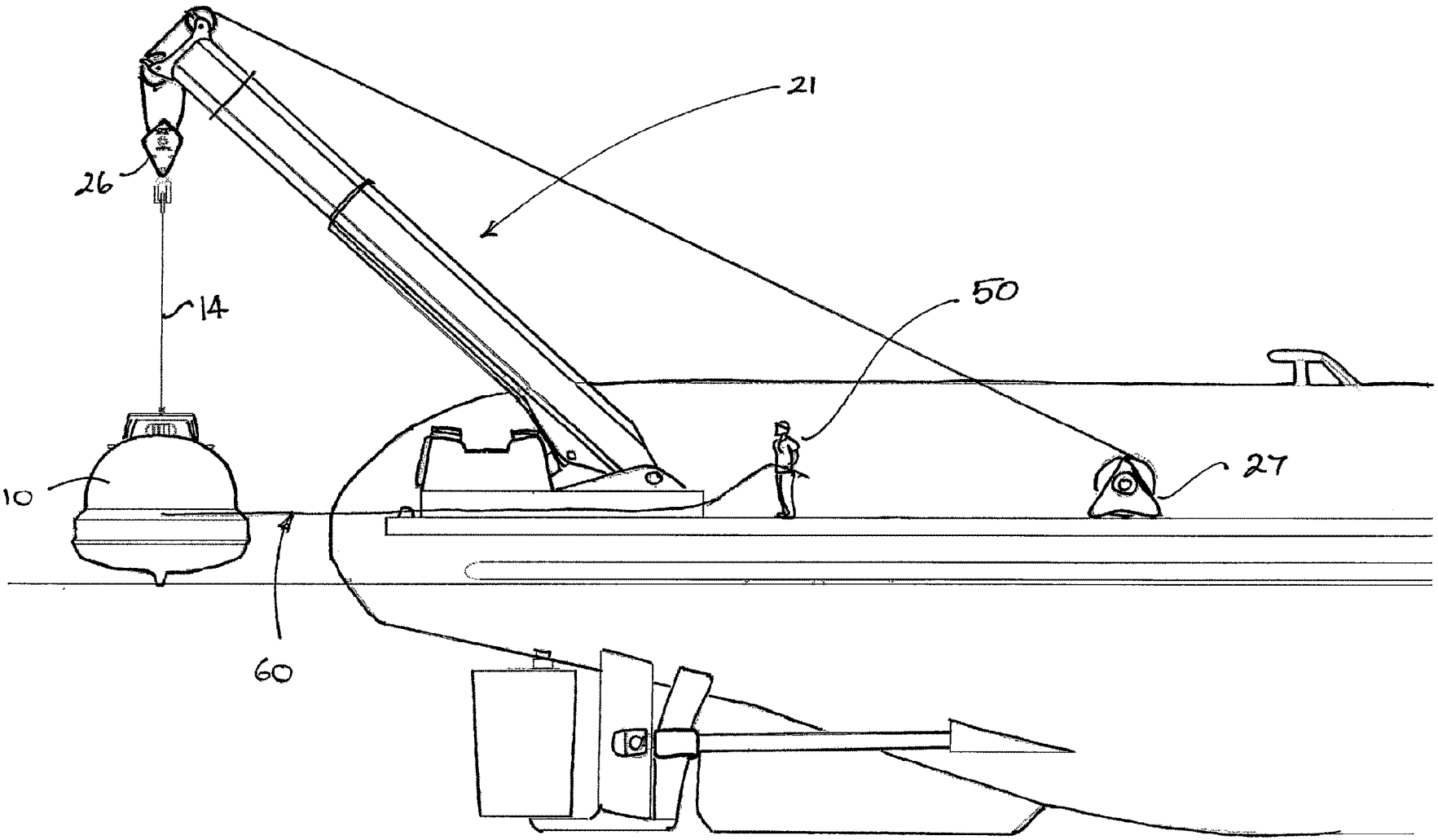
FIG. 39 is a side view of a recovery vessel retrieving a lifeboat vessel following capture of the connection link of the lifeboat vessel in accordance with another step of the method of the present invention.
Figure 40:
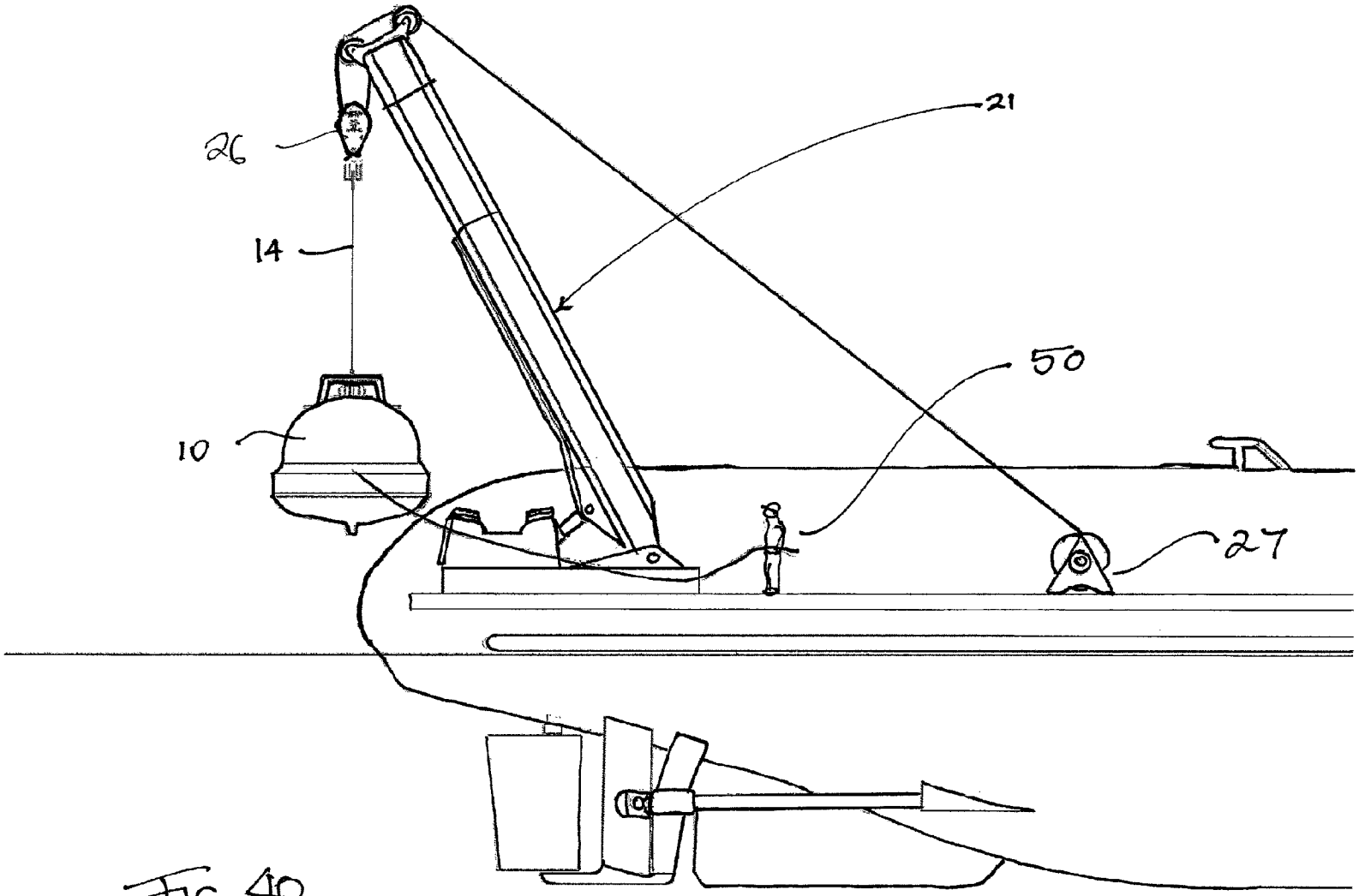
FIG. 40 is a side view of a recovery vessel retrieving a lifeboat vessel following capture of the connection link of the lifeboat vessel in accordance with another step of the method of the present invention.
Figure 41:
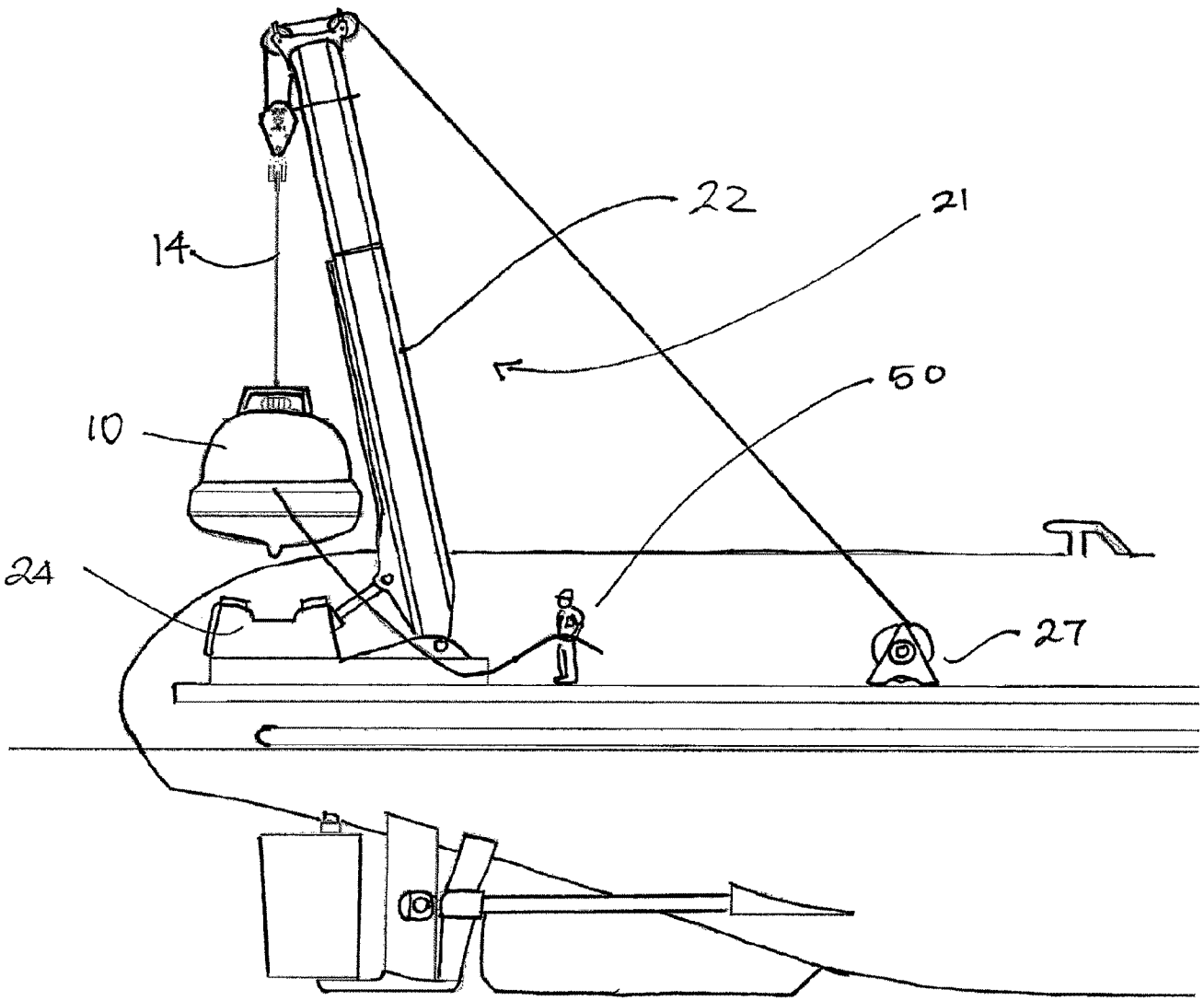
FIG. 41 is a side view of a recovery vessel retrieving a lifeboat vessel following capture of the connection link of the lifeboat vessel in accordance with another step of the method of the present invention.

At this stage, lifting of the lifeboat 10 can be undertaken as shown in FIG. 39. This may be achieved by firstly activating the winch 27 to lift the hook 26. As the A-Frame structure is in a lowered position with the hook 26 immediately above the lifeboat, lifting of the hook 26 causes the lifeboat to be lifted out of the water in the manner as shown. By the crew 50 of the vessel 20 keeping tension on the taglines, the lifeboat 10 is prevented from swinging as it is raised. When the hook 26 is in the highest position, the A-Frame structure 22 is able to be raised by the actuators 28, into a more forward or upright position, as shown in FIG. 40. Continual movement of the A-Frame structure 22 into an upright position occurs until the lifeboat is located above the cradle 24 as is shown in FIG. 41.

Figure 42:
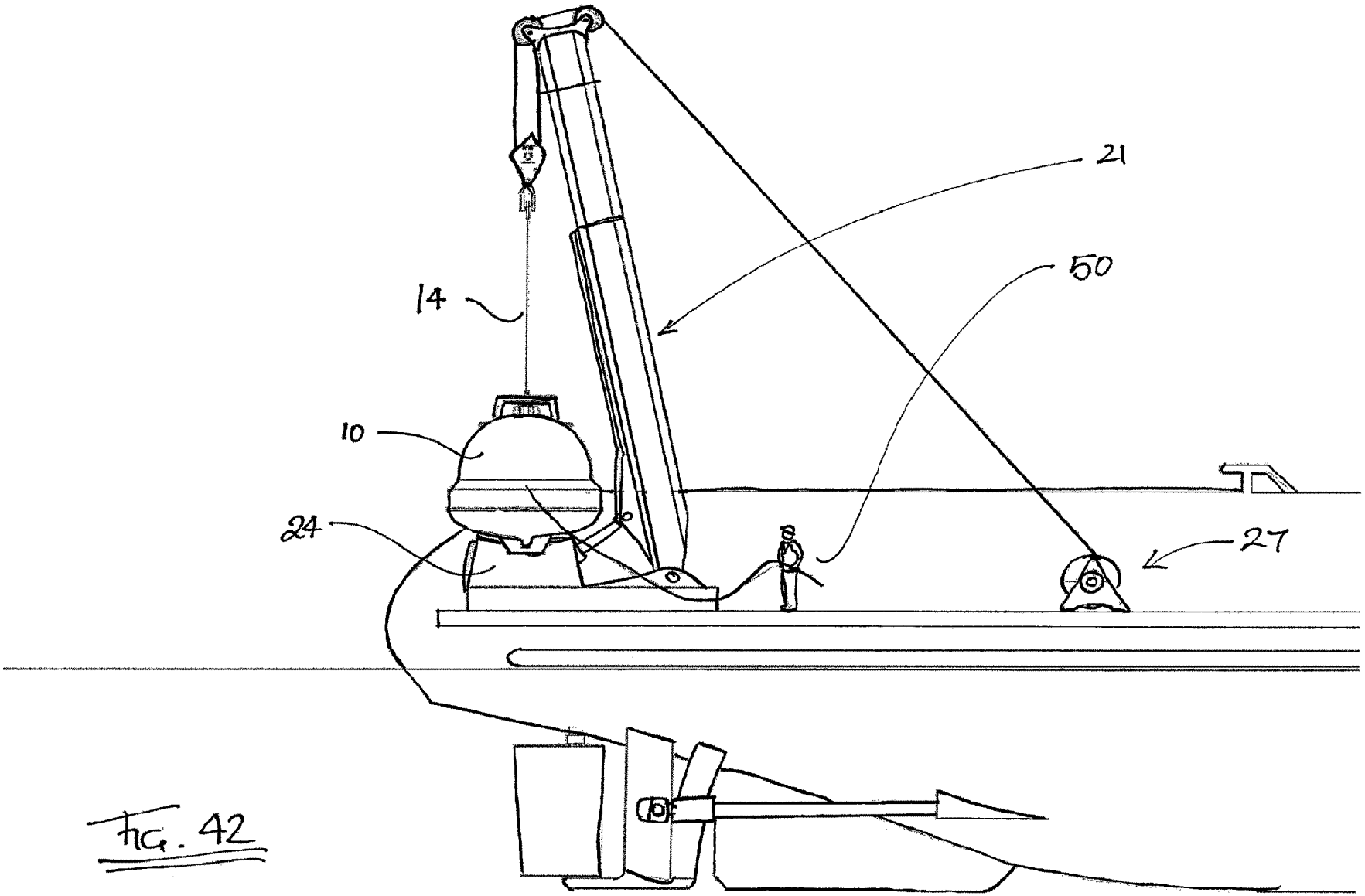
FIG. 42 is a side view of a recovery vessel showing the retrieved lifeboat vessel following capture of the connection link of the lifeboat vessel in accordance with another step of the method of the present invention.

In FIG. 42, the retrieval process is completed by the hook 26 being lowered by the winch 27 to locate the lifeboat 10 in the cradle 24. The crew members may then further secure the lifeboat 10 in this position through the use of various tie-down straps and the likes at which time the vessel 20 can then proceed to port in haste, to treat the divers within the lifeboat, as required.

It will be appreciated from the above referenced description that the act of securing the lifting sling 14 of the lifeboat to the hook 26 of the vessel's lifting device 21 is performed in a simple and efficient manner, without the need for any individual on the lifeboat to come into contact with the hook 26. This is particularly relevant in rough seas where both the recovery vessel 20 and the lifeboat 10 may be moving irregularly with respect to each other. In the system of the present invention, the connection arrangement 40 is initially provided to the lifeboat 10 by way of a connector at the end of a rope or line, which can simply be attached to the masterlink 12 of the lifeboat by a coxswain present on the lifeboat. This completes the coxswain's role in the attachment process, and allows the coxswain to be maintained in a state of relative safety with respect to the lifting equipment of the vessel.

Whilst not shown, the system and method as depicted above can be simply and effectively employed in use to retrieve an unmanned vessel, such as a hyperbaric rescue capsule (HRC). In such an application, prior to deployment of the HRC, the connection arrangement 40 is connected to the masterlink provided on the HRC lifting sling via the connector 44. The connection arrangement 40 may be bundled together with a set of taglines 40 and a tow line that is attached to a buoy at an end thereof. Upon deployment of the HRC the buoy will float on the surface of the water and can be simply collected by the recovery vessel 20 upon approach to the HRC. The crew present on the recovery vessel 20 would then thread the free end of the connection arrangement through the sheave 30 of the lifting hook 26 whilst the lifting hook 26 is idle on the deck of the recovery vessel 20. The procedure as discussed above can then be employed to lift the HRC from the water without any crew required on the HRC.

It will be appreciated that the manner in which the connection arrangement 40 is attached to the sheave of the hook, ensures that by simply pulling on the connection arrangement, the masterlink 12 of the lifeboat will be captured by the hook. As the system is self-aligning, the masterlink 12 can be captured even in event of rough seas, where such manual alignment has proven very difficult.

Whilst the present system has been described in relation to the use of a pre-existing hook arrangement, it will be appreciated that the present invention could be applied to any variety of hook arrangements that may exist in the market or which may be custom made for any purpose. Any such hook can be adapted for the present system through the provision of a sheave in alignment with the hooking member. This enables the masterlink 12, or similar link, to be remotely drawn passed and/or through the hooking member and captured without any need to manually connect and manipulate the arrangement into engagement.

By providing such a simple and efficient means of connecting a lifeboat to the lifting device of the recovery vessel, a lifeboat can be quickly collected at sea and transported to shore in minimal time which is important in instances where the lifeboat is a hyperbaric lifeboat carrying divers at pressure.

Throughout the specification and claims the word "comprise" and its derivatives are intended to have an inclusive rather than exclusive meaning unless the contrary is expressly stated or the context requires otherwise. That is, the word "comprise" and its derivatives will be taken to indicate the inclusion of not only the listed components, steps or features that it directly references, but also other components, steps or features not specifically listed, unless the contrary is expressly stated or the context requires otherwise.

It will be appreciated by those skilled in the art that many modifications and variations may be made to the methods of the invention described herein without departing from the spirit and scope of the invention.

The invention claimed is:

1. A retrieval system for retrieving a vessel from water to a deck of a recovery vessel, comprising:

a lifting device mounted on the deck of the recovery vessel, the lifting device comprising a substantially vertically extending structure and a lifting hook mounted to said substantially vertically extending structure so as to be raised and lowered therefrom by way of a first winch;

a capture member carried by the lifting hook, the capture member having:

a second winch for lowering a connection lead therefrom, the connection lead having a light weight free end to detachably connect to a connection link of the vessel to be retrieved from the water, the second winch also being configured to raise the connection lead and the connection link of the vessel to be retrieved from the water to the capture member;

a capture mechanism configured to capture the connection link of the vessel when the free end of the connection lead is raised by the second winch; and a control member configured to direct the connection link to the capture mechanism to be captured thereby as the free end of the connection lead is raised by the second winch;

wherein upon capture of the connection link by the capture mechanism the first winch is operated to facilitate lifting of the vessel from the water to the deck of the recovery vessel.

2. A retrieval system according to claim 1, wherein the substantially vertically extending structure of the lifting device comprises a frame structure.

3. A retrieval system according to claim 2, wherein the frame structure is an A-frame structure and the lifting hook is mounted to a central portion of the A-frame structure.

4. A retrieval system according to claim 1, wherein the capture member is configured to be suspended from the lifting hook.

5. A retrieval system according to claim 4, wherein the capture member is substantially U-shaped to define a space into which the connection link is captured by the capture mechanism.

6. A retrieval system according to claim 5, wherein the control member comprises a pulley mounted above the space over which the connection lead passes.

7. A retrieval system according to claim 6, wherein actuation of the second winch causes the connection lead to travel over the pulley such that the connection link is raised into the space for capture by the capture mechanism.

8. A retrieval system according to claim 5, wherein the capture mechanism comprises a locking pin mounted to one side of the capture member and is movable to extend across the space to engage with an opposing side of the capture member to capture the connection link.

9. A retrieval system according to claim 8, wherein the locking pin is movably connected to an actuator to facilitate movement of the locking pin between a first position wherein the locking pin extends across the space to close the space, and a second position wherein the locking pin is located remote from the space to open the space.

10. A retrieval system according to claim 9, wherein the actuator is remotely controlled.

11. A retrieval system according to claim 1, wherein the connection lead comprises a cable that is configured to pass over the control member.

* * * * *